US010427028B2

(12) United States Patent
Greenawalt

(10) Patent No.: US 10,427,028 B2
(45) **Date of Patent: *Oct. 1, 2019**

(54) TILES ON SHAPES PUZZLE GAME

(71) Applicant: Thomas H. Greenawalt, Palm Harbor, FL (US)

(72) Inventor: Thomas H. Greenawalt, Palm Harbor, FL (US)

( * ) Notice: Subject to any disclaimer, the term of this patent is extended or adjusted under 35 U.S.C. 154(b) by 61 days.

This patent is subject to a terminal disclaimer.

(21) Appl. No.: 15/473,021

(22) Filed: Mar. 29, 2017

(65) Prior Publication Data

US 2017/0197140 A1 Jul. 13, 2017

Related U.S. Application Data

(63) Continuation-in-part of application No. 14/531,409, filed on Nov. 3, 2014, now Pat. No. 9,937,410, which
(Continued)

(51) Int. Cl.
*A63F 3/00* (2006.01)
*A63F 3/04* (2006.01)
(Continued)

(52) U.S. Cl.
CPC ..... *A63F 3/0423* (2013.01); *A63F 3/00574* (2013.01); *A63F 2001/0483* (2013.01);
(Continued)

(58) Field of Classification Search
CPC ..... A63F 2003/0034; A63F 2003/0035; A63F 3/00574; A63F 2003/00716;
(Continued)

(56) References Cited

U.S. PATENT DOCUMENTS 1,327,775 A * 1/1920 Platt ..... G09B 1/36 310/87
1,980,637 A * 11/1934 Savory ..... A63F 3/00176 273/272

(Continued)

OTHER PUBLICATIONS

International Search Report and Written Opinion issued by the International Searching Authority dated Feb. 27, 2013 for international patent application No. PCT/US2012/035967.

(Continued)

*Primary Examiner* — William M Pierce
(74) *Attorney, Agent, or Firm* — Robert Varkonyi; Zagrebelsky Law P.A.

(57) ABSTRACT

A tile-on-shape puzzle game is disclosed using a plurality of unique shape designs having one or more tile projections disposed on one or both faces of the shape. The tile projections are adapted to fit in a recess on a play tile. Optional play cards are used to provide clues or shape designations and scores. Shapes are played to form a puzzle, with each player selecting where to place a shape, thereby forming a unique puzzle each time the game is played. Tiles must fill every play space on a shape to form a word or numerical/shape sequence. Gameplay provides a means to simultaneously generate and solve puzzles. Play options include competitive or cooperative play, and may be varied based on age and skill level, such as limiting the word or sequence direction to left-right, up-down, diagonal, or a combination thereof, or forming pathways with the puzzle.

20 Claims, 15 Drawing Sheets

Related U.S. Application Data is a continuation-in-part of application No. PCT/US2012/035967, filed on May 1, 2012.

(51) Int. Cl.
*A63F 1/04* (2006.01)
*A63F 11/00* (2006.01)

(52) U.S. Cl.
CPC ..... *A63F 2003/0063* (2013.01); *A63F 2003/0428* (2013.01); *A63F 2011/0062* (2013.01)

(58) Field of Classification Search
CPC ..... A63F 2003/00719; A63F 3/0423; A63F 3/0426; A63F 3/0428
USPC ..... 273/282.1; 446/118, 171
See application file for complete search history.

(56) References Cited

U.S. PATENT DOCUMENTS 2,023,300 A * 12/1935 Barnett ..... A63H 33/04 446/118
2,091,555 A * 8/1937 Messinger ..... G09B 17/00 434/172
2,415,342 A * 2/1947 Donner ..... G09B 17/00 273/160
3,993,313 A * 11/1976 Tillotson ..... A63F 9/0073 273/282.1
4,185,833 A * 1/1980 McKee ..... A63F 1/00 273/157 R
4,222,181 A * 9/1980 Cummings ..... A63F 9/0098 40/605
4,249,336 A * 2/1981 Moe ..... A63H 3/04 248/448
4,298,200 A * 11/1981 Kanbar ..... A63F 9/0669 273/148 A
4,741,538 A * 5/1988 Lewis ..... A63F 3/0423 273/148 A
4,776,597 A * 10/1988 Rudell ..... A63F 3/0423 273/241
5,035,666 A * 7/1991 Kang ..... A63F 9/0098 446/118
5,048,840 A * 9/1991 Johnson, Jr. ..... A63F 3/00214 273/241
5,054,789 A * 10/1991 Pellerin ..... A63F 3/0423 273/288
5,221,094 A * 6/1993 Hanson ..... A63F 9/18 273/431
5,282,631 A * 2/1994 Baker ..... A63F 3/0423 273/153 R
5,288,068 A * 2/1994 Roth ..... A63F 3/0423 273/153 R
5,310,061 A * 5/1994 Kanbar ..... A63F 1/10 206/555
5,554,062 A * 9/1996 Goldsen ..... A63F 9/0098 434/171
5,560,611 A * 10/1996 Kim ..... A63F 3/0415 273/241
5,649,703 A * 7/1997 Kanbar ..... A63F 1/04 273/157 R
5,769,421 A * 6/1998 Wakefield ..... A63F 3/0423 273/272
5,799,943 A * 9/1998 Morgan ..... A63F 3/0423 273/160
5,860,653 A * 1/1999 Jacobs ..... G06Q 10/107 273/272
6,769,692 B1 * 8/2004 Cavalluzzo ..... A63F 3/0423 273/272
6,966,556 B1 * 11/2005 Culley ..... A63F 1/04 273/272
7,044,467 B1 * 5/2006 Dimmig ..... A63F 3/04 273/272
7,267,341 B2 * 9/2007 Shah ..... A63F 3/0423 273/272
7,695,357 B2 * 4/2010 Fleury ..... A63F 3/00 273/236
7,789,393 B2 * 9/2010 Tucker ..... A63F 1/18 273/272
9,950,219 B2 * 4/2018 Larson ..... A63B 53/0466
2006/0087077 A1 * 4/2006 Balanchi ..... A63F 3/0423 273/239
2011/0084446 A1 * 4/2011 Chan ..... A63F 3/0423 273/272
2011/0260400 A1 * 10/2011 Harrison ..... A63F 3/0023 273/287
2013/0277914 A1 * 10/2013 Cheng ..... A63F 3/00574 273/287
2013/0341868 A1 * 12/2013 Vandoren ..... A63F 3/00697 273/290
2015/0283452 A1 * 10/2015 Chuang ..... A63F 3/0023 273/272

OTHER PUBLICATIONS

International Preliminary Report on Patentability issued by the International Bureau dated Nov. 13, 2014 for International patent application No. PCT/US2012/035967.
Restriction Requirement issued by the United States Patent and Trademark Office dated Aug. 14, 2015 for corresponding utility U.S. Appl. No. 14/531,409.
Non-Final Office Action issued by the United States Patent and Trademark Office dated Feb. 1, 2016 for corresponding utility U.S. Appl. No. 14/531,409.
Final Office Action issued by the United States Patent and Trademark Office dated Aug. 17, 2016 for corresponding utility U.S. Appl. No. 14/531,409.

* cited by examiner

TILES ON SHAPES PUZZLE GAME

CROSS-REFERENCE TO RELATED APPLICATIONS

This nonprovisional application is a continuation-in-part of U.S. application Ser. No. 14/531,409, filed Nov. 3, 2014, entitled "Tiles on Shapes Puzzle Game"; which is a continuation-in-part of PCT Appl. No. PCT/US2012/035967, entitled "Tiles on Shapes Puzzle Game", filed on May 1, 2012, and claims priority to the application, the contents of which are hereby incorporated by reference.

FIELD OF THE INVENTION

This invention relates to puzzle games. Specifically, the invention is a game utilizing discrete puzzle shapes and tiles in a puzzle-solution game.

BACKGROUND OF THE INVENTION

Education games have been developed as an entertaining way to expand the knowledge base of children and/or adults. Vocabulary and spelling, such as Scrabble®, typically involve placing letter tiles onto a set game board to form a row of words. However, most games only provide one educational skill set at a time. For example, most word games focus just on vocabulary, placing words onto a game board with minimal critical analysis.

Wakefield (U.S. Pat. No. 5,789,421) discloses a word game using tiles and dice. A player is given a letter and rolls the dice to determine the number of tiles to select. The player then selects tiles and attempts to form a word with the tiles.

Cavalluzzo (U.S. Pat. No. 6,769,692) discloses a word game using a gameboard face having rows of playing squares and columns aligning with each row, indicating the number of letter tiles to drawn for forming a word in the corresponding column, the number of letters needed to be played in the row to qualify for a bonus, and the amount of bonus received. Words may be started at any location on the row's playing squares to maximize scoring.

McKee (U.S. Pat. No. 4,185,833) discloses a guessing game using one or more matrix with a code sheet. The code sheet indicates which elements to combine in the matrix to form a line, or other indicia on the matrix, which combine to make up an image or letter. The players are given portions of the letter or word via the matrix code and must guess the letter or word.

Lewis (U.S. Pat. No. 4,741,538) discloses a game where players move an indicated number of spaces onto a board space to purchase the letter indicated on that tile. The object of the game is to form a word that maximizes the player's letters. Once formation of a word, other players landing on the letters of the word must pay a "pay out" fee. The first player to reach a determined amount of money is the winner.

Culley, et al. (U.S. Pat. No. 6,966,556) discloses a card game where players are select a number card, indicating the number of letter cards given to each player, and category card. The players receive letter cards and must make a word pertaining to the category on the category card.

However, the educational word games focus on forming words, with no or minimal focus on other critical thinking skills, like strategy. Puzzle games, such as Blokus®, typically involve placing geometric shapes onto a set game board for a preset challenge. Therefore, what is also needed is a new game that provides education, such as word skills, number skills/mathematics, shape matching skills, color matching skills, and strategy skills, with puzzle solving.

SUMMARY OF THE INVENTION

A tile-on-shape puzzle game is disclosed comprising at least one tile and at least one playing shape. The tiles have an upper face, four edges, and a lower face, with a play indicia disposed on the upper face. Examples of indicia include a letter, number, color, shape, fruit, icon, character, animal, candy, or a combination of indicia. The play indicia are optionally printed onto tile. Exemplary means to print the indicia include hot foil pressed onto the tile, and silk-screen printed onto the tile, ink printing. In some variations of the invention, the tile is dimensioned to fit into a recess in the at least one shape. Optionally, the tile includes a projection on its lower face adapted to fit into a recess in the shape. In these variations, the projection may be excess material, a magnet, or second material. Where the projection is formed from excess material, the excess material is optionally molded on the tile during the formation of the tile or glued onto the tile. Where the projection is a magnet or second material, the magnet or second material is adhered onto the tile using an adhesive, screw, tack or other means known in the art.

The at least one shape has a shape surface with a first face and a second face and at least one tile recess disposed on the first face. The tile recess comprises a void on the face of the shape, which is dimensioned to fit the tile or a projection on the lower face of the tile. The recess forms a plurality of lips adjacent to the four edges, and is adapted to fit a tile projection. The shape may also include at least one tile recess disposed on the second face and corresponding to the inverse location of the at least one tile recess disposed on the first face. The tile recess is optionally a square-like octagonal shape, a square-like shape having rounded corners, a plurality of cylindrical projections, or a square. The tiles may be optionally fixed to the shapes during play using a textured or friction material, such as those described in Harrison, et al. (U.S. application Ser. No. 12/997,030). Optionally, the friction material is added to the tile recess, the tile projection, or a combination thereof. In other variations, the lower face of the tile Tiles can be square, square-like with rounded corners, octagonal, triangle, circle, hexagon, other geometric shape, curved to fit onto sections of a curved shape, as described below, or three dimensional, such as a house, castle, rock, cube, or other shape known in the art.

The at least one tile and at least one shape may be made of wood, cardboard, high density fiberboard, high density cardboard, high density paper, acrylonitrile butadiene styrene (ABS), high impact polystyrene (HIPS), acrylic (PMMA), cellulose acetate, cyclic olefin copolymer (COC), ethylene-vinyl acetate (EVA), ethylene vinyl alcohol (EVOH), polyvinylfluoride (PVF), polyvinylidene fluoride (PVDF), polytetrafluoroethylene (PTFE), polychlorotrifluoroethylene (PCTFE), fluorinated ethylene-propylene (FEP), perfluoroalkoxy polymer (PFA), polyethylenechlorotrifluoroethylene (ECTFE), polyethylenetetrafluoroethylene (ETFE), perfluoropolyether (PCPE), acrylic/PVC polymer, aromatic polyester polymers (liquid crystal polymer), polyoxymethylene (acetal), polyamide (PA, nylon), polyamide-imide (PAI), polyaryletherketone (PAEK), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoate (PHA), polyketone (PK), polyester, polyethylene (PE), polyetheretherketone (PEEK), polyetherimide (PEI), polyethersulfone (PES), chlorinated polyethylene (CPE), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), styrene-acrylonitrile (SAN).

The shapes provide puzzles that are solved by connecting new shapes to the existing puzzle and placing tiles on the shapes to form a word, number alignment, word searching, or matched indicia, such as icons, colors, etc. As such, the puzzle is both created and solved simultaneously. Alternatively, only a portion of the shape may be colored, such as the shape surface or the tile protrusion. The remainder of the shape may be molded in a standard color, such as white, wood grain, or beige. The shapes may also include edges that are colored to identify edges that may connect together. For example, where the shapes provide curved bodies with flattened edges, the edges may be colored to identify the surfaces which are eligible for connection to other shapes and the location on the other shape that may accept the curved shape.

The puzzle game may also include a plurality of play cards, having at least an indicia face. The indicia face includes a shape identifier and score value, a specific challenge, gameplay theme, gameplay threat, or a clue. The plurality of playing cards may include two indicia faces or an indicia face and an obscuring face. The obscuring face may include the game title, an ornamental design, a picture or other image, or a combination therefore. Other means to obscure the indicia face are known in the art and do not deviate from the invention. The play cards are optionally made of any material known in the art, such as laminated cardboard, high density cardboard, high impact polystyrene, wood, acrylonitrile butadiene styrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polyc aprolac tone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile. The play cards may also include uniquely colored indicia on the play face which correspond to a color of a shape design. For example, a shape may be molded in a color, such as yellow, red, green or blue with a card having the corresponding shape design on its indicia face and the corresponding color also displayed on the indicia face.

The game optionally also includes a die or cube. The die or cube is optionally a challenge cube providing for challenges, such as a length of word or color to be played.

The game includes a plurality of tiles having a tile face and tile underside, with indicia of play is disposed on the tile face of the plurality of tiles. Exemplary indicia include a letter, number, color, shape, fruit, character, animal, icon, or candy. A plurality of playing shapes is also used, as described above. The tiles are optionally shaped as a square-like octagonal shape, a square, or a square-like shape having rounded corners. However, other configurations are known in the art, such as those described Harrison, et al. (U.S. application Ser. No. 12/997,030).

The tiles are mixed together, such as in a bag or pile, and each player selects a plurality of tiles from the bag or pile to form a player's tile pile. The tiles optionally comprise between fifty and one hundred fifty single or dual-letter tiles, eight tiles without assigned letter, and twelve tiles designated as an empty space, depending on the game. For example, path-building games optionally use fifty-four to sixty-four tiles having color, shape, fruit, character, animal, icon, or candy on the tile face. Number games optionally use one hundred five tiles having numbers on the tile face. The word play game optionally uses between eighty and one hundred sixteen tiles. In some variations, the word play game does not use tiles without assigned letter. Some variations do not use the tiles without assigned letter, dual-letter tiles, or empty space tiles. The color matching game optionally uses ninety tiles, in four different colors. The colors are optionally red, blue, yellow, and green. The color matching game does not use letter tiles, empty space tiles. Some variations use a "wild space" tile, allowing a player to use the tile as any color, whereas some variations do not use a "wild space" tile. Where the "wild space" tile is used, the game optionally uses four "wild space" tiles.

The shapes cards are shuffled and at least a portion of the cards dealt to each player prior to play. The remaining cards are placed in a stack with obscuring face facing up. Alternatively, the shape cards are only drawn during a player's turn. For example, in playing with curved shapes, the cards are shuffled and selected at the beginning of a player's turn, indicating the shape that is played during the player's turn. In other variations, the cards act as challenge cards, activity cards, or mission cards. In these embodiments, the cards use an obscuring face and indicia face, where the indicia face describes a challenge that must be handled by the player or team. Examples include removing tiles from one or more players, removing played tiles from the game, skipping gameplay turns, removing shapes from one or more players, and exposing new hazards in the gameplay. Cards may also include character cards, providing a character for the player and describing play attributes unique to that character. Alternative variations use a die or cube. The die or cube may include dots or numbers, or colors. The die or cube is optionally a challenge cube providing for a challenge. The challenge may be a word length goal or color goal for gameplay. Where the challenge goal is met, a player is awarded additional points.

Play begins by placing a first shape to form a puzzle. Where shape cards are used, the player selects a shape card and collects the shape corresponding to a shape identifier on the shape card. The player must then place one tile from the player's tile piled onto each play surface of the played shape to form at least one word, match, or sequence on the played shape. After successfully playing a shape, the player then plays the shape card, where shape cards are used. Play continues by placing another shape onto the game, such that the new shape contacts at least one other shape on the game to form a game puzzle. The player must then place his or her tiles onto each play surface as before. Alternatively, gameplay proceeds with each player obtaining tiles on an "as-needed" basis, i.e. a free-for-all play. The first player continues to play shapes until he or she is unable to place shapes down, or cannot form words on every play surface of a shape. At this point, the player replenishes his or her tile pile and shapes or shape cards from the shape card deck. Optionally, if the player successfully connects a shape to more than one existing shape on the puzzle, the player is given a bonus and selects an additional tile for each played shape that connected to more than one shape. Play optionally moves to the next player, with play continuing until a scoring event is triggered, wherein the scoring event is the first player to complete use of the player's shapes, the exhaustion of cards in a shuffled "draw" deck, or every player is unable to place a shape in the same round. The score is then tallied for each player, using played shape cards, played shapes, or the first player to complete use of the player's shapes. For shape cards, the score value disposed on the indicia face is used to tally the player's score. Where a player cannot successfully connect a shape to the puzzle, the player exchanges a plurality of tiles from the player's tile pile, a plurality of shape cards, or a combination thereof.

Also included is an aligning tile-on-shape game comprising letter tiles and playing shapes. The playing shapes have a rectangular shape surface with a plurality of play surfaces disposed on the first face of the playing shape. A plurality of clue cards is used, having an indicia face and an obscuring face; where the indicia face includes a clue. Each clue card originates from a unique category, such as "wild letter", "random letter", "before and after", "rhyme", "starts with", and "categories". The tiles are mixed together in a pile and the clue cards shuffled. Play is initiated by selecting a first clue card and providing a solution to the clue. The solution is optionally between three and five letters. The player then selects tiles from the pile to form the solution and places the solution onto the playing shape. Play continues, using up the play shapes. Alternatively, each player draws 25 tiles randomly, which form the player's tile pile. A single clue card is selected for each round and the clue is used by every player to form the solution, as provided above. Optionally, there are five rounds. At the completion of the rounds, or when every player is unable to place a shape in the same round, play ceases and each player attempts to aligning the playing shapes to form at least one vertical word. Optionally, a round is completed when a player has created a vertical word through moving the straight shapes or reorganizing the shapes and sliding the shapes to align letters vertically.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Disclosed is a unique puzzle game where you are simultaneously creating and solving the puzzle. Shapes are added to the puzzle prior to playing the letter tiles to form words on the shapes, number tiles to play number sequences, equations, icon/color matches, or series, or other shapes. The illustrated variations of the game pieces describe the game used as a word game, although the invention is not limited to such a game and other embodiments of the game using non-letter tiles are envisioned. Further, the shape pieces may be varied in design from the shapes described herein.

Figure 1A:
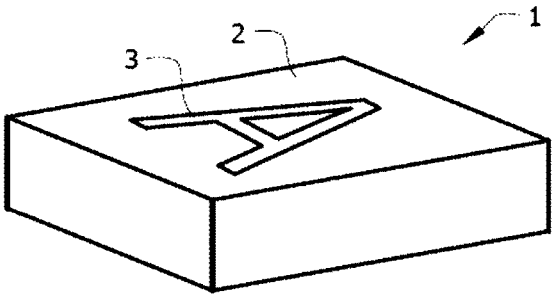
FIG. 1(A) is an isometric view of the tile, partially showing the indented recess.
Figure 1B:
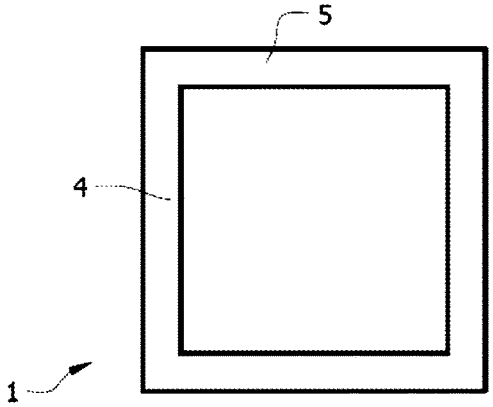
FIG. 1(B) is a bottom-up view of the tile, showing the projection on the tile.
Figure 1C:
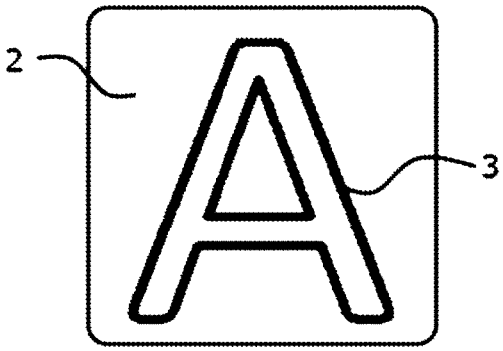
FIG. 1(C) is a top-down view of the tile, showing an alterative shape of the tile.

The game consists of tiles 1 which fit onto predesigned shapes 10 to form at least one word. Tile 1 may be formed of high impact polystyrene (HIPS), acrylonitrile butadiene styrene (ABS), cardboard, high density cardboard, high density fiberboard, wood or other material known in the art. Tile 1 consists of upper tile face 2, containing play indicia 3, as seen in FIG. 1(A). Play indicia 3 can be, for example, a letter, number, color, shape, or other design permitting matching of design or sequence and is printed onto tile 1 by means known in the art, such as hot foil, ink printing, or silk-screen printing. Tile 1 is adapted to fit onto shape 10. In some variations, tile 1 is dimensioned to fit into recess 11 on shape 10. Alternatively, tile 1 includes tile projection 5 on lower tile face 4, as seen in FIG. 1(B). Tile projection 5 may be formed of the same material as tile 1, may be formed of a magnetic material, such as a magnet or magnetic sheet, or may be formed of a second material. Where the projection is formed from excess material, the excess material is optionally molded on the tile during the formation of the tile or glued onto the tile. Where the projection is a magnet or second material, the magnet or second material is adhered onto the tile using an adhesive, screw, tack, or other means known in the art. The tile is optionally shaped as a square-like octagonal shape, a square, or a square-like shape having rounded corners, as seen in FIG. 1(C).

Figure 1D:
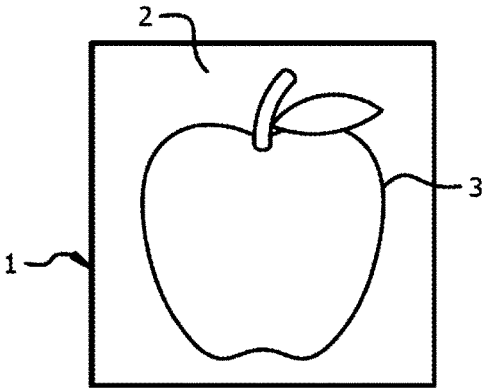
FIG. 1(D) is a top-down view of the tile, showing a variation of the tile with a fruit indicia.
Figure 1E:
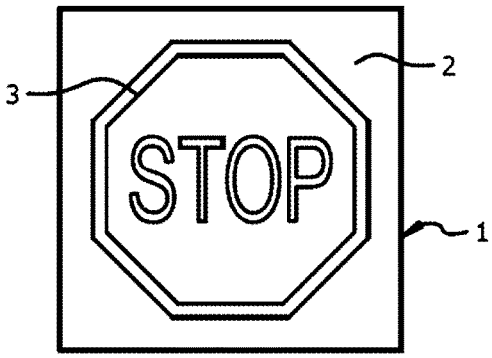
FIG. 1(E) is a top-down view of the tile, showing a variation of the tile with a gameplay indicia.
Figure 1F:
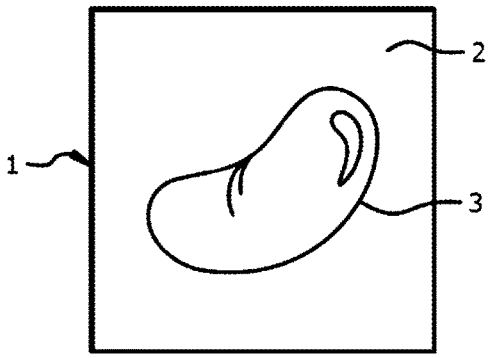
FIG. 1(F) is a top-down view of the tile, showing a variation of the tile with a candy indicia.
Figure 1G:
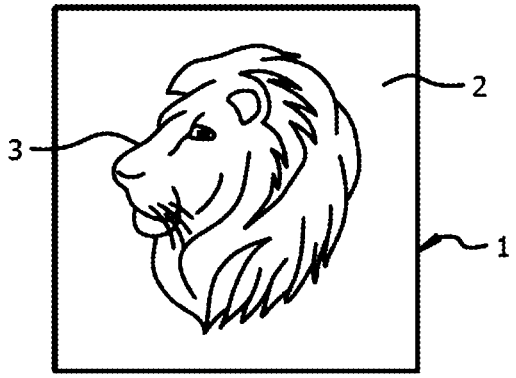
FIG. 1(G) is a top-down view of the tile, showing a variation of the tile with an animal indicia.
Figure 1H:
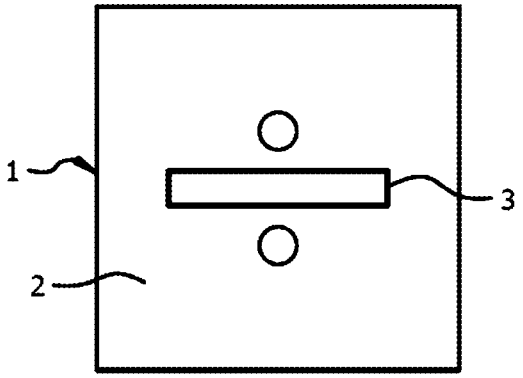
FIG. 1(H) is a top-down view of the tile, showing a variation of the tile with a mathematical operator indicia.
Figure 1I:
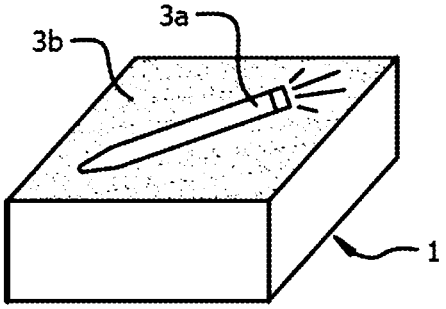
FIG. 1(I) is a top-down view of the tile, showing a variation of the tile with a combination of indicia. The illustrative example shows color and a gameplay element.
Figure 1J:
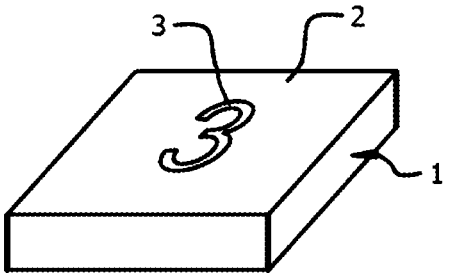
FIG. 1(J) is a top-down view of the tile, showing a variation of the tile with a number indicia.

For word games, play indicia 3 is a letter, a combination of two letters together, such as "QU", a "wild" (★) tile, or a "block" (■) tile. The "wild" tiles can be played as any letter, provided such use forms a word in any direction. The "block" tile, the position on the shape is blocked out, permitting a player to form separate words in the same direction on the same shape. Also, new shapes may be connected to block tiles. In addition to letters, upper tile face 2 include play indicia that are fruit, as seen in FIG. 1(D), board game play instructions, as seen in FIG. 1(E), candy, as seen in FIG. 1(F), animals, as seen in FIG. 1(G), or mathematical operators, such as in FIG. 1(H). In some variations, tile 1 includes a plurality of play indicia, such as first play indicia 3*a* and second play indicia 3*b*, as seen in FIG. 1(I). As seen in the illustrative example depicted in the image, first play indicia 3*a* is shown as a play icon, and second play indicia 3*b* shown as a color. However, the tiles can be marked by play indicia as would be obvious to one of skill in the art, upon examination of the specification. Further, numbers can be included on upper tile face 2, as seen in FIG. 1(J).

Figure 2A:
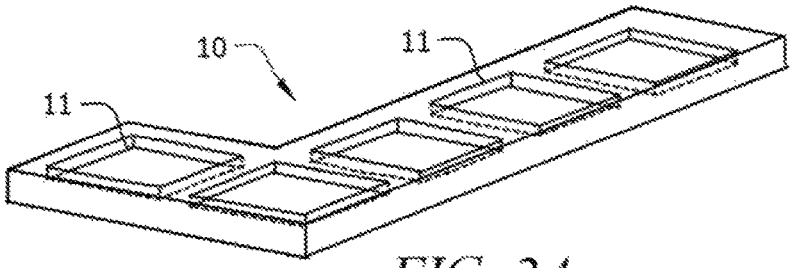
FIG. 2(A) is an isometric view of the diagram of an exemplary shape used in the present invention, showing the tile recess on the first face.
Figure 2B:
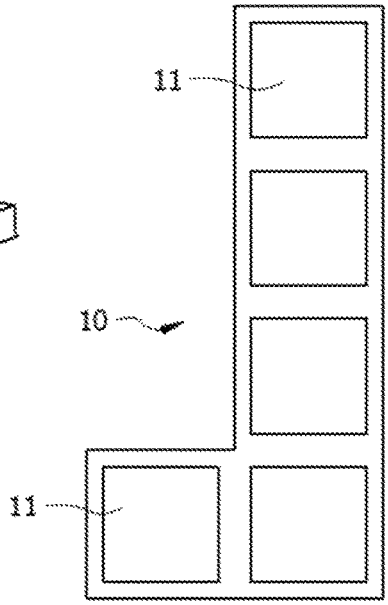
FIG. 2(B) is a top down view of an exemplary shape used in the present invention, showing the shape design and tile recesses.
Figure 2C:
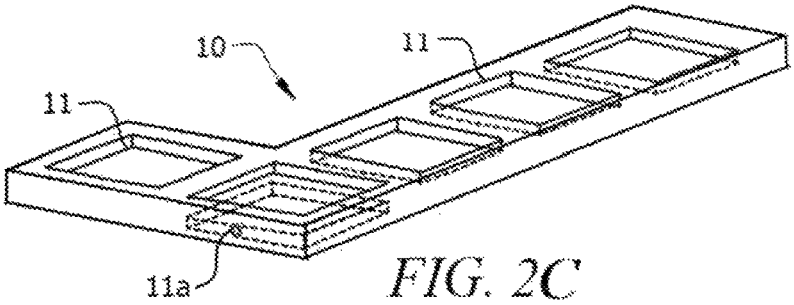
FIG. 2(C) is an isometric view of the diagram of an exemplary shape used in the present invention. A single tile recess is displayed on the reverse face.
Figure 3:
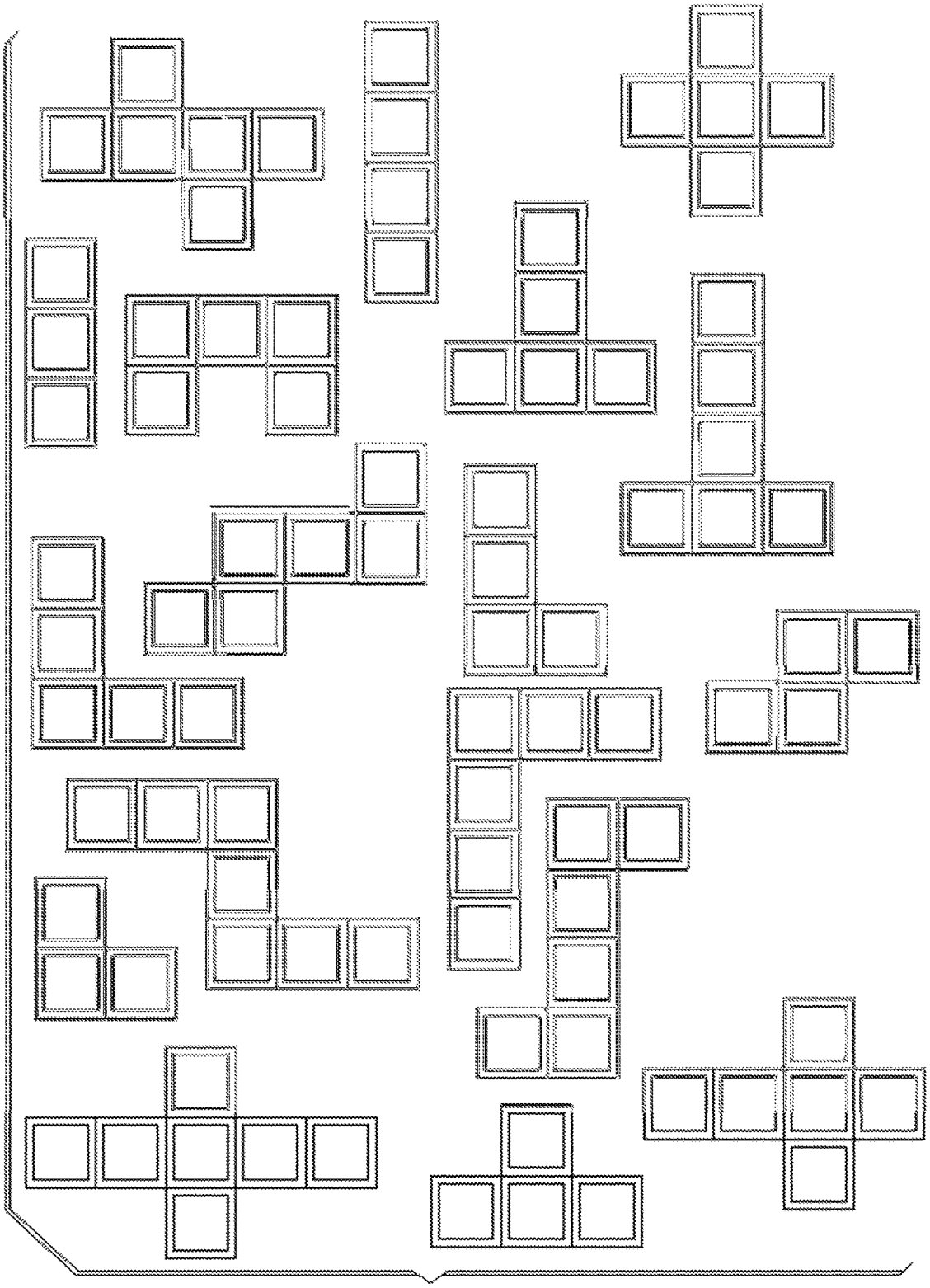
FIG. 3 is a plurality of diagrams showing the shape designs in one embodiment of the present invention.

Shape 10 is formed of cardboard, high density paper, high density cardboard, high density fiberboard, high impact polystyrene (HIPS), acrylonitrile butadiene styrene (ABS), or other material known in the art, and includes at least one recess 11 on a first side of shape 10, as seen in FIG. 2(A). Optionally, the recesses are also disposed on the second side. Recess 11 has a square or square-like shape, as seen in FIG. 2(B), dimensioned to accept tile 1 or tile protrusion 5. Tile recesses 11*a* provide play surfaces on one side of the shape, while tile recesses 11*b* provide play surfaces on the inverse face of the shape, permitting a player to orient the shapes for game play as he or she desires, as seen in FIG. 2(C). There are 16 distinct tile shapes, as seen in FIG. 3. While it is within the scope of the invention to only provide tile recesses on one side of the shape, some shapes are orientated such that the shape is symmetric about a vertical axis (horizontally flipped) or about a horizontal axis (vertically flipped), which increase the difficulty of the game play.

In some embodiments, tile recess 11 is at least 1/16 inch deep and tile 1 is at least 3/32 inch thick, thereby ensuring tile 1 is secured onto shape 10, yet still protrudes slightly enabling a player to access the tile. Where tile protrusion 5 is provided, tile protrusion 5 is at least 3/64 inch thick, allowing tile protrusion 5 to fit securely within recess 11. For example, recess 11 9/16 inch by 9/16 inch by 1/16 inch deep with corresponding octagonal tile protrusion 5 dimensions of 5/8 inch by 5/8 inch by 3/4 inch thick. The interior face of recess 11 optionally includes a textured or friction material to further secure the tile onto shape 10. Alternatively, the exterior face of tile protrusion 5 may include the textured or friction material or both the tile protrusion and lip both include the texture or friction material.

Figure 4A:
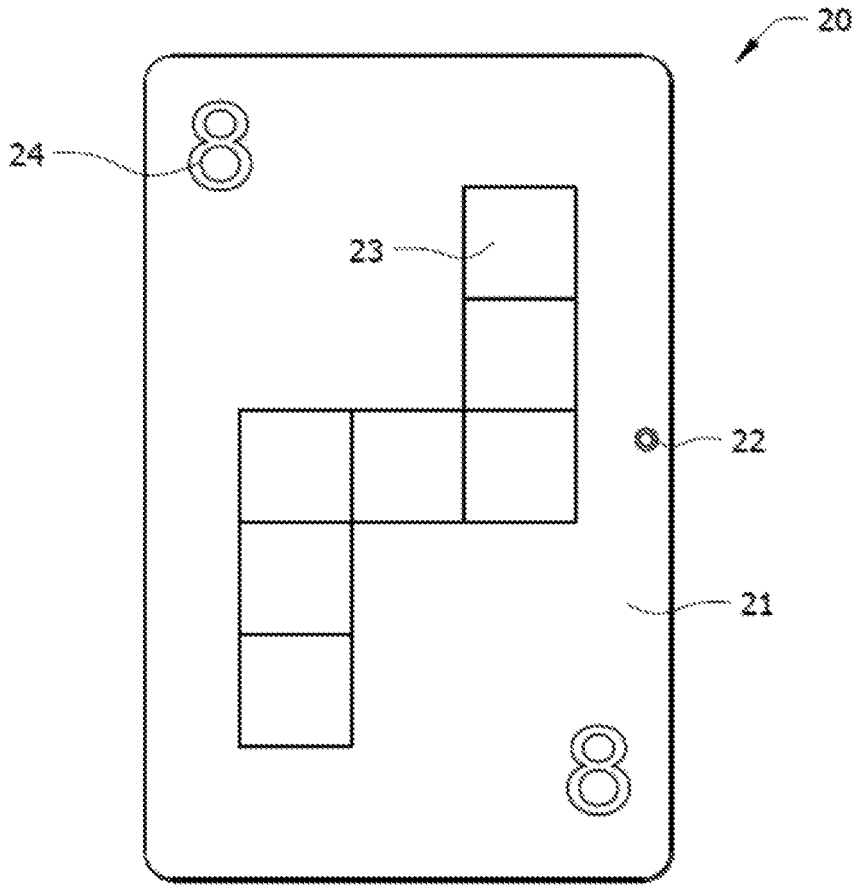
FIG. 4(A) is a diagram of a shape card, showing the indicia face of the card. The indicia face of the shape card displaying score values and the designated shape.
Figure 4B:
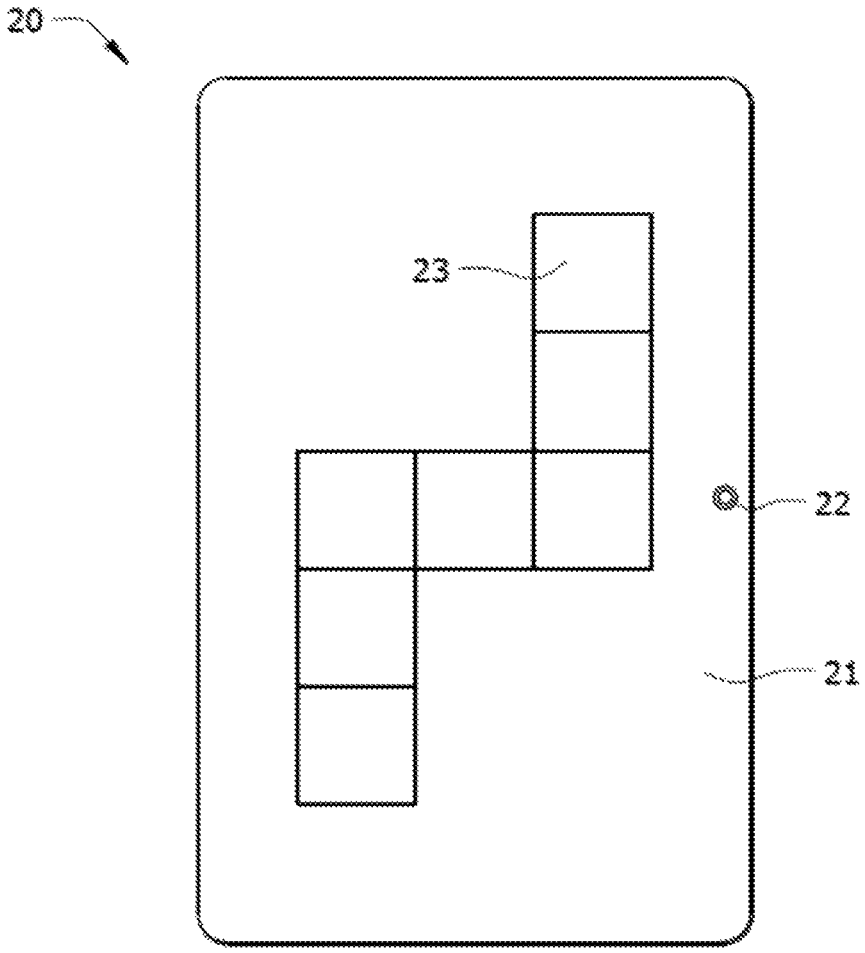
FIG. 4(B) is a diagram of a shape card, showing the indicia face of the card. The indicia face of the shape card displays only the designated shape
Figure 4C:
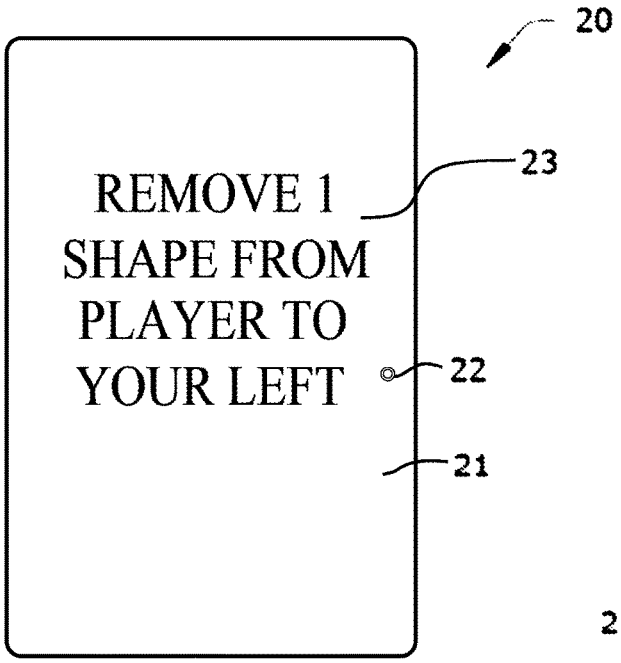
FIG. 4(C) is a diagram of a shape card, showing the indicia face of the card. The indicia face of the shape card displays a gameplay instruction.

Play cards 20 are formed of any material known in the art, such as laminated cardboard, high impact polystyrene (HIPS) or acrylonitrile butadiene styrene (ABS). Shape card 20 has two indicia faces 21, or an indica face 21 and an obscuring face 22. Obscuring face 22 may include the game's title or other design, preventing a player from identifying the markings on the indicia face of the card. Indicia face 21 includes gameplay topics or shape identifier 23 and score value 24, thereby identifying the shape to be played and the score associated with the identified shape, as seen in FIG. 4(A). Optionally, the shapes are uniquely colored, corresponding to the shape and number of spaces, and also correspond to color indicia on play cards 20, thereby permitting simplified identification of the play shape. For example, where play card 20 displays a seven-space shape, as indicated in FIG. 4(B), the color of the printing can be yellow. The corresponding shape 10 can be molded in yellow or shape form 12 can be molded in yellow with tile protrusion 11 being a standard color or tile protrusion 11 molded in yellow with shape form 12 molded in a standard color, such as white or beige. In other variations, play card 20 has gameplay instructions provided on the indicia face 21, as seen in FIG. 4(C).

Example 1

This variation uses a speed-based game using twenty shapes 10 in twelve distinct designs, as seen in FIG. 3. The game uses one hundred sixteen tiles 1, which include one hundred sixteen assigned letter tiles. These can be in addition to the one hundred sixteen letter tiles or in place of some letter tiles. Alternatively, the game uses only letter tiles. Play cards containing gameplay themes on both sides of the card are used, along with a die. The cards contain 2 themes, such as "animals" and "capitals".

Figure 4D:
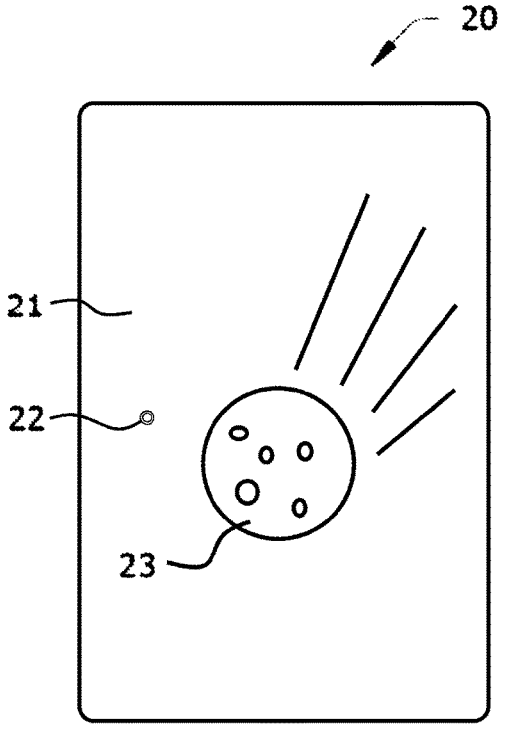
FIG. 4(D) is a diagram of a shape card, showing the indicia face of the card. The indicia face of the shape card displays a gameplay hazard.
Figure 4E:
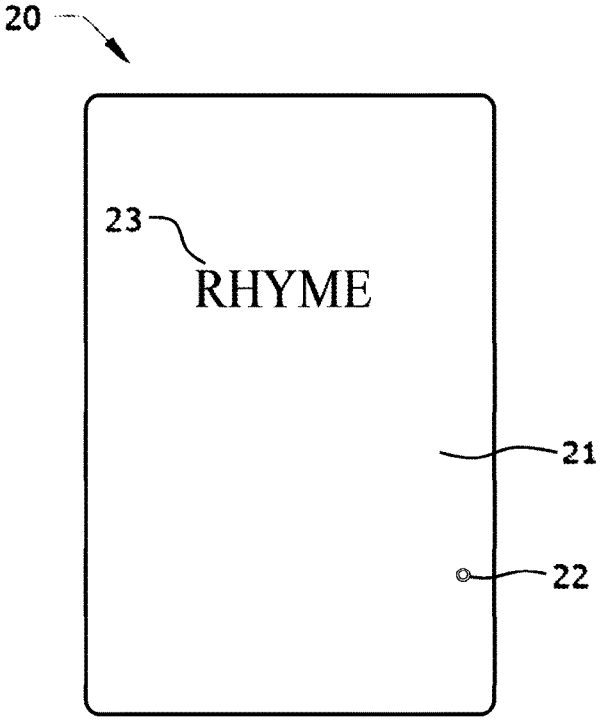
FIG. 4(E) is a diagram of a shape card, showing the indicia face of the card. The indicia face of the shape card displays a gameplay topic.
Figure 4F:
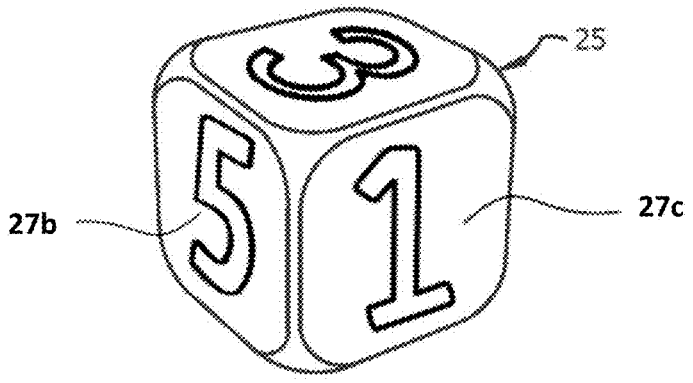
FIG. 4(F) is an isometric diagram of a die, showing three indicia face of the die. The indicia faces display Arabic numerals.
Figure 4G:
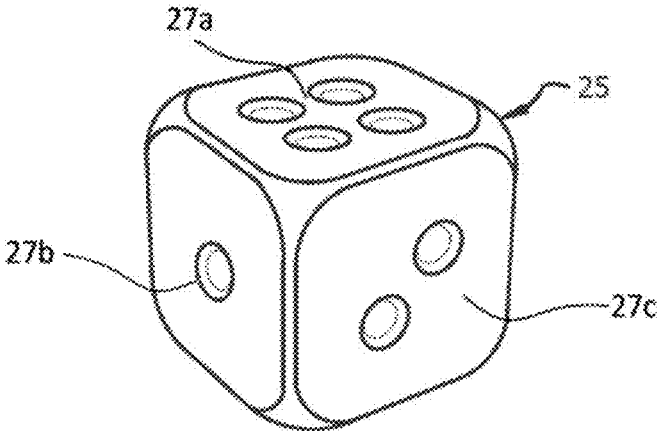
FIG. 4(G) is an isometric diagram of a die, showing three indicia face of the die. The indicia faces display dots on the face.

Each player selects number of shapes, based on the number of players. For a four player game, each player selects 4 shapes. For a three player game, each player selects 5 shapes, and for a two player game each player selects six shapes. The first player rolls die 25, seen in FIG. 4F or 4G, draws a card and selects one of the two the gameplay topics displayed on the card. Die 25 includes first indicator 27*a*, second indicator 27*b*, third indicator 27*c*, and so on. As seen in FIGS. 4F and 4G, the indicators can be numbers or dots. The die designates the word length for the gameplay in the round and the topic designates subject matter for the words. Scores are awarded for words that are of the designated word length or satisfy the gameplay topic. Words that satisfy both the topic and word length are scored twice. For example, if the die rolls "4" and the topic selected is "capitals", words such as "fork", "cart", and "bibs" meet the word length and are scored "1" each, words such as "Atlanta" (capital of Georgia), "Paris" (capital of France), "London" (capital of U.K.) would score "1" each, and words such as "Lima" (capital of Peru), and "Kiev" (capital of Ukraine) would score "2" each.

Each player aligns his or her shapes 10 on a playing surface, such as a table, with each shape connected to at least one other shape. Alternatively, each player places his or her shapes as desired. Tiles 1 are placed into a pile, and each player simultaneously selects tiles as desired to form words. Tiles are inserted into each tile recess 11 of shape 10 forming one or more words in any direction. To successfully play a shape, tiles 1 must form a word. Additionally, the letter on a played space "connected" shape space must be used as part of the word on the newly placed shape. Where a "wild" tile is used, the "wild" letter is not a fixed letter during play, i.e. the "wild" letter is changed by each player connecting to the wild tile based on the player's needs. Strategic use of the "wild" or the "block" letter, as well as placement of the shape, alters gameplay by blocking a player's access to a shape placement or permitting play. However, some variations of the invention do not use "wild" tiles. Abbreviations or hyphened words and single letter words are not permitted. In some variations, prefixes and suffixes are also not permitted. The game is optionally played forming words in any direction, i.e. top-to-bottom, bottom-to-top, left-to-right, and right-to-left. Alternatively, for a classic looking and challenging game, words must be formed left-to-right or top-to-bottom. Where the player can successfully play multiple shapes, the player continues adding shapes to the puzzle.

Play continues until a player has played all of that player's shapes, a player has announced he or she has completed the gameplay, or every player is unable to place a shape in the same round. At the end of play, scores are determined based on the number of words that satisfy the gameplay topic and/or word length, as discussed above. Optionally, points are also awarded for completing the gameplay first and for total number of words played. Points are deducted for every tile in the player's possession.

Example 2

This variation uses a turn-based game using sixteen or twenty shapes 10 in twelve distinct designs, as seen in FIG. 3. Shapes 10 are assigned varying point values ranging from one to eight. Sixteen or twenty cards 20, corresponding to each of shapes 10 are used to designate the point value for each shape and indicate which shapes a player is assigned to play. The game uses one hundred twenty-four tiles 1, which include one hundred four assigned letter tiles, eight "wild" letters that can be used as any letter, and twelve "block" tiles that function as a blank space to permit multiple words on a shape.

Shapes 10 are placed together on a playing surface, such as a table, ensuring there is adequate space to play and connect shapes. Tiles 1 are placed into a bag and mixed. Each player selects eight tiles from the bag and places the tiles in front of the player. Shape cards 20 are shuffled and cards dealt to each player. For four players, three cards are dealt to each player. For two or three players, four shape cards are dealt to each player. The remaining shape cards are placed on the table with obscuring face 22 facing up. Each player selects a single tile from tile bag to determine the starting player and then returns the tile to the bag. The player with the letter closest to "A", not including the wild or the block, goes first. Play moves clockwise.

Figure 5:
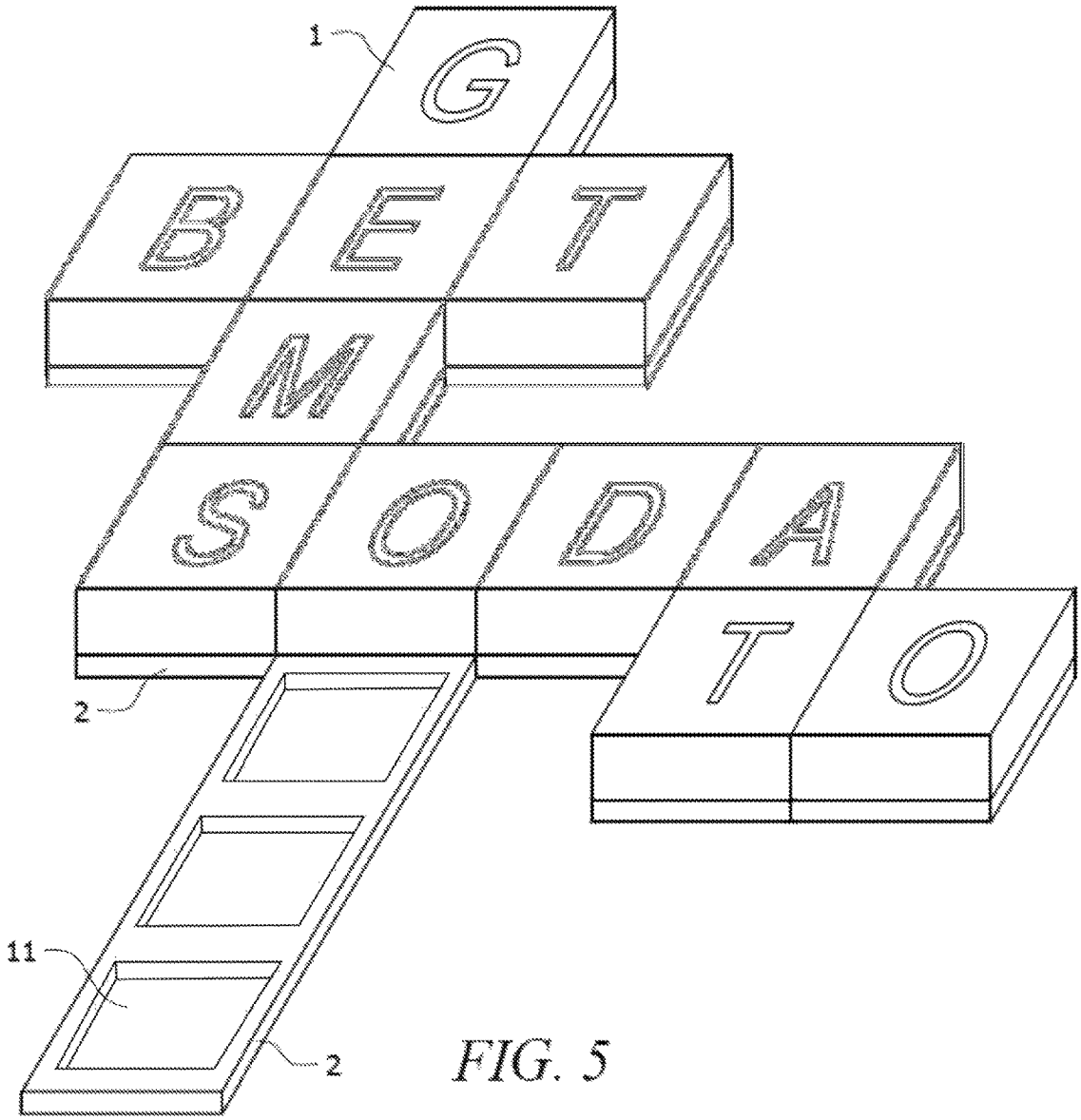
FIG. 5 is an isometric view of a puzzle of the present invention.

During a turn, the player selects at least one shape card 20 and collects a shape corresponding to shape identifier 23 on the shape card. Shape 10 is placed on the table, with each shape played connecting to one or more shapes previously played, i.e. the new shape connecting to puzzle 8, with the exception of the first shape played in the game, to form puzzle 8, as seen in FIG. 5. Placement of the shape is dictated by the player's ability to form a word using the letter adjacent to the played shape and strategic use of shapes to prevent other players from successfully playing shapes, especially high value shapes. Tiles 1 are selected from the player's tiles 1*a*, which are optionally stored on tile rack 9 until needed, and placed onto each tile protrusion 11 of shape 10 forming one or more words in any direction. To successfully play a shape, tiles 1 must be placed on every tile protrusion 11 of shape 10, with a two letter minimum word. Additionally, the letter on a played space "connected" shape space must be used as part of the word on the newly placed shape. Where a "wild" tile is used, the "wild" letter is not a fixed letter during play, i.e. the "wild" letter is changed by each player connecting to the wild tile based on the player's needs. Strategic use of the "wild" or the "block" letter, as well as placement of the shape, alters gameplay by blocking a player's access to a shape placement or permitting play. Abbreviations, acronyms, proper names, or hyphened words are not permitted. Alternatively, for a classic looking and challenging game, words must be formed left-to-right or top-to-bottom. Where the player can successfully play multiple shapes, the player continues adding shapes to the puzzle If a shape cannot be played, any or all tiles 1 or shape cards 20 may be exchanged by discarding the unwanted tiles and/or cards and selecting shape cards from the shuffled deck and tiles from the tile bag.

Upon completing a turn, the player places the shape cards representing the successfully played shapes in front of the player for later scoring. The player then replenishes the player's tiles 1*a* from the tile bag to reach eight tiles, and replenishes any played shape cards from the shape card deck. Where a player successfully connected a shape to more than one existing shape on puzzle 9, the player is given a bonus and draws an additional tile for each played shape that connected to more than one shape.

Play continues until a player has played all of that player's shape cards and the shuffled "draw" deck is exhausted, or every player is unable to place a shape in the same round. At the end of play, shape cards are used to determine score. Score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

Example 3

Gameplay is similar to Example 2, but provides for a shorter game. Each player randomly selects eight shape cards 20 from the shape deck and selects ten tiles 1. Gameplay continues as described in Example 2, without replacing the shape cards. Play ends when a player exhausts his or her shape cards, or when all players cannot successfully play a shape in a single round.

Example 4

Gameplay is similar to Example 2, but provides for a shorter game. Each player randomly selects ten tiles 1. Each player concurrently selects a shape and plays his or her tiles, and continues to play until the player is unable to successfully play a shape, use his or her tiles, or both, depending on the game. As such, every player is playing at the same time. Gameplay continues as until all players exhaust his or her shape cards, or when all players cannot successfully play a shape.

Example 5

Gameplay is similar to Example 2, but tiles 1 are imprinted with numbers, from one through six, as indicia 3 on tile face 2. Shape 10 is played on the puzzle such that a numerical sequence or parity, i.e. odd or even numbers, can be formed, using every tile projection 11 on shape 10. Tiles 1 are then placed onto shape 10 to form a sequence or parity. Non-limiting examples of sequences are prime numbers, sequences of square numbers, sequences of square root numbers, Fibonacci sequence, Lucas sequence, and mathematical equations. An example of a successful mathematical equation sequence could be 4, 3, and 1 representing 4 minus 3 equals 1. Tile 1 also includes "wild" and "block" tiles. As in Example 2, "wild" tiles may be changed to any number by each player connecting to the wild tile based on the player's needs, and "block" tiles are used to stop a numerical sequence or parity.

Play continues as described in Example 2, until a player has played all of that player's shape cards and the shuffled "draw" deck is exhausted, or every player is unable to place a shape in the same round. At the end of play, score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

Example 6

Gameplay is similar to Example 2, but tiles 1 are imprinted with icons or color combinations, as indicia 3 on tile face 2. In some embodiments, the tiles are three distinct icon designs or three colors combinations. Shape 10 is played on the puzzle such that a single color/icon tiles in lines of matching color or icon can be formed, using every tile projection 11 on shape 10. Tiles 1 are then placed onto shape 10 to form a matching color or icon sequence. Tile 1 optionally also includes "wild" and "block" tiles. As in Example 2, "wild" tiles may be changed to any color or icon by each player connecting to the wild tile based on the player's needs, and "block" tiles are used to stop a sequence. In embodiments which match tiles, such as color or icon, the shape is placed with color or icon imprinted on the player's tiles matching the color or icon of the adjacent tiles on the puzzle. Alternatively, the tiles may be matched based on categories, such as citrus fruits being played together, pomaceous fruits (apples, pears, Japanese plum) played together, berries played together, etc.

Play continues as described in Example 2, until a player has played all of that player's shape cards and the shuffled "draw" deck is exhausted, or every player is unable to place a shape in the same round. At the end of play, score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

Example 7

Figure 6:
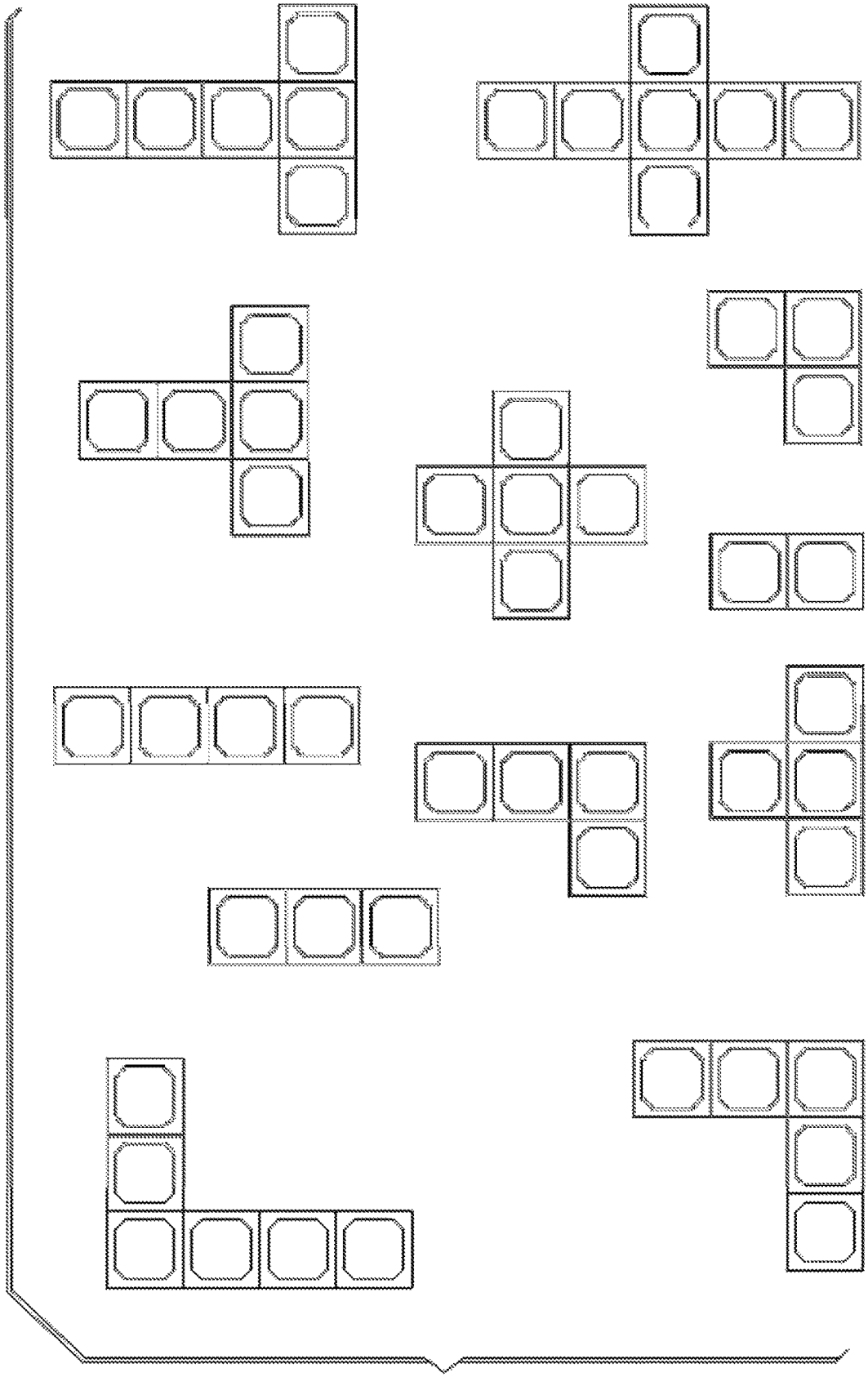
FIG. 6 is a plurality of diagrams of the shape designs of the present invention for the timed game embodiment. An alternative geometric shape is shown for the tile recess.

This variation is a time-based game using forty-eight shapes 10 in twelve distinct designs, with each distinct design of four shapes, as seen in FIG. 6. Shapes 10 are assigned varying point values ranging from one to eight. Thirty-two shape cards 20, corresponding to each of shapes 10 are used to designate the point value for each shape and indicate which shapes a player is assigned to play. The game uses one hundred twenty-four tiles 1, which include one hundred four assigned letter tiles, eight "wild" letters that can be used as any letter, and twelve "block" tiles that function as a space to permit multiple words on a shape.

Shape cards 20 are shuffled and three to four cards dealt to each player. In some embodiments, each player is given the same shape cards. Alternatively, each player selects the shape cards, such as four cards, for play. The remaining shape cards are placed deck face down on the table. In some embodiments, the values on the shape cards are used to determine the number of tiles the player is permitted to collect for the player's tile pile. Alternatively, shape cards 20 do not have any score values 24, as seen in FIG. 4(B). It is envisioned that shape cards 20 are split into four equal decks, having the same assigned shapes in each deck such that each player has access to all available shapes. Alternatively, shape cards 20 are not used, and each player is given the same shapes, i.e. same designs, and instructed which three or four shapes are to be used to start play.

Shapes 10 are placed together on a playing surface, such as a table, ensuring there is adequate space to play and connect shapes. Tiles 1 are placed into a bag and mixed, and each player randomly selects twenty-four tiles from the bag and places the tiles face down in front of the player. For a more challenging game, each player starts with the same number of tiles as on the total spaces on the four initial shapes. For example, where each player is give a "2-tile protrusion" shape, a "4-tile protrusion" shape, a "6-tile protrusion" shape, and a "1-tile protrusion" shape, the player selects thirteen tiles.

Shapes 10 are placed together on a playing surface, such as a table, ensuring there is adequate space to play and connect shapes. Alternatively, each player is given a collection of shapes 10 for play. After each player has selected their tiles and shapes, play begins with each player independently creating his or her own puzzle using the shapes and tiles to for words. To successfully play a shape, tiles 1 must be placed on every tile protrusion 11 of shape 10, with a two letter minimum word. Additionally, the letter on a played space "connected" shape space must be used as part of the word on the newly placed shape. Where a "wild" tile is used, the "wild" letter is not a fixed letter during play, i.e. the "wild" letter is changed by each player connecting to the wild tile based on the player's needs. Abbreviations, acronyms, proper names, or hyphened words are not permitted. Shape 10 is placed on the table, with each shape played connecting to one or more shapes already played, with the exception of the first shape played in the game, to form puzzle 8, as seen in FIG. 5. Tiles 1 may be placed on tile protrusions 11 in any direction to form a word; left-to-right, right-to-left, top-to-bottom, or bottom-to-top direction. Alternatively, for a classic looking and challenging game, words must be formed left-to-right or top-to-bottom.

Where a player cannot successfully play any shapes, the player yells "stumped" and draws six additional tiles, along with the next shape card in the card deck. It is noted that the game provides enough tiles for 4 additional sets of shapes and tiles. For further challenge, in a "Stumped" situation, the player draws the next shape card 20 in the deck, and only selects additional tiles equal to the spaces on your additional shape. For example, where the "stumped" player selected a "2-tile protrusion" shape, the player selects two additional tiles. Play continues until a player has successfully created words on all of their shape cards or every player is unable to place a shape on their respective complete puzzle.

The winner is the player to complete their puzzle first, i.e. to use all the shape cards 20 in their hand. On a mutually agreed upon "stopped" round, the winner of the round is the player with the fewest shapes. The tiebreaker is the player with the fewest empty spaces. For extended play, play continues for an additional round or rounds by placing shape cards 20 back in the deck and the letter tiles placed in the bag and starting new puzzles. The winner is the first player to win 3 rounds (with 4 players), to 4 rounds (with 3 players), and to 5 rounds (with 2 players).

Example 8

Figure 7A:
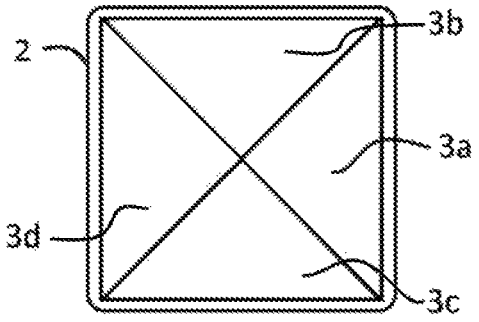
FIG. 7(A) is a diagram of an embodiment of the tile, showing an example of color indicia.

This variation game is turn-based using either sixteen or twenty shapes 10 in twelve distinct designs, as seen in FIG. 6. The game uses ninety to one hundred tiles 1, which possess four colors on the tile face, as seen in FIG. 7(A). In this case, the indicia are a first indicia 3*a*, second indicia 3*b*, third indicia 3*c*, and fourth indicia 3*d*. The colors can be different from the other colors on the tile face or can be the same, i.e. the color can be present on more than one color portion. In some variations, tiles 1 include a wild tile.

Each player selects shapes for use and tiles for play. In some variations, each turn beings with a player in possession of shapes and selecting eight tiles from a bag. Play begins by placing a shape on a starting base and using the shapes and tiles to connect the shapes and match the tile color indicators. For example, a first tile possesses a green portion, red portion, blue portion and yellow portion and a second tile possesses a green portion, red portion, and two blue portions. The player connects two shapes, and places tiles such that a green portion of the first tile matches the green portion of the second tile, or a blue portion of the first tile aligns with a blue portion of the second tile, etc. To successfully play a shape, tiles 1 must be placed on every tile protrusion 11 of shape 10, with all color portions matching the color portions of adjacent tiles. The remaining tiles are returned to the bag and play then moves to the next player. In some variations, where wild tiles are used in gameplay, but not utilized in a player's round, the wild tile is not returned to the bag.

Where a player cannot successfully play any shapes, the play moves to the next player. Play continues until a team or player has successfully used all shapes or every player or team is unable to place a shape on their respective complete puzzle.

Scoring is determined based on the matching of shapes and tile play. Points are awarded for successfully playing a shape (1 point), playing a shape without using a wild tile (1 point), connecting shapes to all play spaces on the starting base (5 points), surrounding a wild tile with four color portions having the same color, i.e. red portions of tiles surrounding a wild tile (5 points), and points are deducted for failing to play a shape (5 points).

Figure 7B:
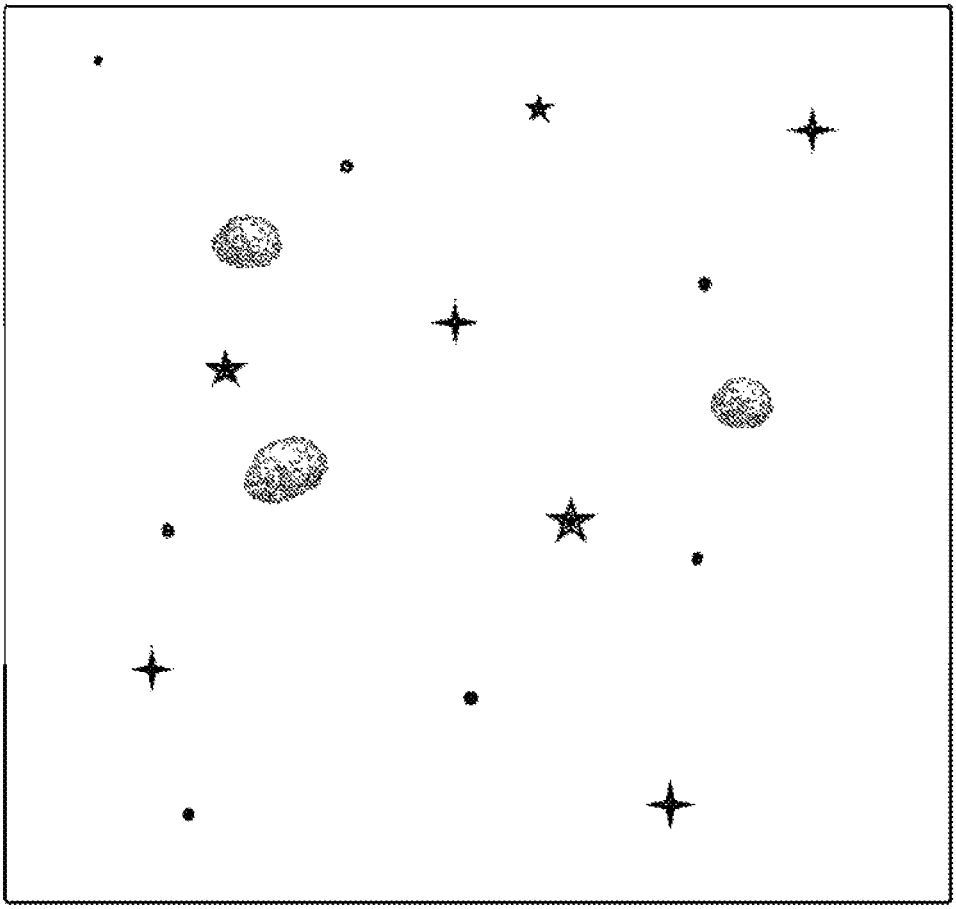
FIG. 7(B) is a diagram of an embodiment showing a star field map for game play.

In alternative variations of the game, the starting base is placed onto a star field map, as seen in FIG. 7(B). The star field map includes images of meteors and other hazards, such as comets or unidentifiable flying objects. The hazards are optionally hidden during start of gameplay, such as by a cover or thin card having an obscuring face that matches the star field, and revealed during gameplay. Alternatively, the hazards are displayed on hazard cards or other material and placed onto the star field map as directed by gameplay cards, as seen in FIG. 4(D). As play commences, players select a gameplay card, which may direct the player to uncover a hazard. During gameplay, the players goal is to connect the shapes, such that the shapes obstruct the revealed hazard.

Example 9

Gameplay is similar to that of Example 8, but incorporating a collaborative gameplay. Each player is assigned a role, such as captain, medic, engineer, with each role assigned a specific ability. For example, the shapes may include a color, with the captain playing a first color, the medic a second color, and the engineer a third color. In specific variations, the medic may have the ability to play a wild tile without affecting the score, the captain may use shapes regardless of color, and the engineer may move one shape in place of his or her turn.

Gameplay begins with a player drawing eight tiles from a bag and selecting from one of twelve shapes, or from one of the colored shapes corresponding to his or her role. The shape is placed on the game and tiles played on the shape as outlined in Example 8. In some variations, additional points are awarded for not using any wild tiles.

Example 10

Gameplay is similar to that of Example 8, but incorporating time-based gameplay. Each player draws twenty-four tiles from the bag and selects four shapes. Thelayer then begins play by placing a shape adjacent to a starting base and adding tiles as outlined in Example 8. The first player to successfully play all his or her shapes announces the end of gameplay. Scoring is similar to Example 8, but with points awarded for completing the shapes first (5 points).

The tiles and shapes are returned and gameplay continues. Gameplay continues for 3 rounds, and points are tallied. Alternatively, the first player to win 3 rounds wins the game.

In other variations, after completing the first round, a second set of shapes and tiles are selected, and gameplay continues on the shapes from the previous round or rounds. Gameplay continues for 3 rounds, and points are tallied. Alternatively, the first player to win 3 rounds wins the game.

Example 11

Gameplay is similar to Example 7, but tiles 1 are imprinted with numbers, from one through six, as indicia 3 on tile face 2. Shape 10 is played on the puzzle such that a numerical sequence or parity, i.e. odd or even numbers, can be formed, using every tile projection 11 on shape 10. Tiles 1 are then placed onto shape 10 to form a sequence or parity. Non-limiting examples of sequences are prime numbers, sequences of square numbers, sequences of square root numbers, Fibonacci sequence, Lucas sequence. Tile 1 also includes "wild" and "block" tiles. As in Example 7, "wild" tiles may be changed to any number connecting to the wild tile based on the player's needs, and "block" tiles are used to stop a numerical sequence or parity.

Play continues as described in Example 7, until a player has played all of that player's drawn shape cards, or every player is unable to place a shape. At the end of play, the winner is the player to complete their puzzle first, i.e. to use all the shape cards 20 in their hand. On a mutually agreed upon "stopped" round, the winner of the round is the player with the fewest shapes. The tiebreaker is the player with the fewest empty spaces. For extended play, play continues for an additional round or rounds by placing shape cards 20 back in the deck and the letter tiles placed in the bag and starting new puzzles. The winner is the first player to win 3 rounds (with 4 players), to 4 rounds (with 3 players), and to 5 rounds (with 2 players).

Points are awarded based on the tiles played and sequences. For example, each tile played except for the "block" tile (1 point).

Example 12

Gameplay is similar to Example 11, but gameplay includes a cube. The cube includes indicia for gameplay. For example, the cube includes indicia for playing 3 tiles from the same number in series, an indicia for playing 3 tiles in a sequence, an indicia for using tiles having numbers that when added together equal 20, an indicia requiring playing at least 5 tiles, an indicia allowing the player to each tiles from another player, and an indicia allowing the player to swap all his or her tiles with those of another player.

The game optionally includes additional tiles, including increased value wild tiles that increase scoring for the sequence played on the file, and "theft" tiles, which allow a player to steal the points from a previously played sequence. Scoring is as provided in Example 11, with points stolen or awarded extra value based on the additional tiles. For example, the "theft" tile awards points to the player whom used the tile, and the increased value wild tiles increase the value of each tile in the sequence (2 points per tile).

Example 13

Figure 4H:
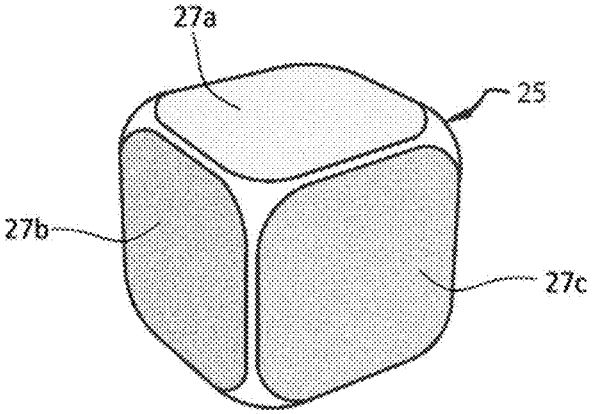
FIG. 4(H) is an isometric diagram of a die, showing three indicia face of the die. The indicia faces display different colors.

Gameplay is similar to Example 7, but tiles 1 are imprinted with icons or color combinations, as indicia 3 on tile face 2. In some embodiments, the tiles are three distinct icon designs or three colors combinations. Shape 10 is played on the puzzle such that a single color/icon tiles in lines of matching color or icon can be formed, using every tile projection 11 on shape 10. Tiles 1 are then placed onto shape 10 to form a matching color or icon sequence. Tile 1 also includes "wild" and "block" tiles. As in Example 7, "wild" tiles may be changed to any color or icon by each player connecting to the wild tile based on the player's needs, and "block" tiles are used to stop a sequence. Optionally, gameplay can include die 25, having first indicator 27*a*, second indicator 27*b*, third indicator 27*c*, and so on, seen in FIG. 4H. As seen in the Figure, indicator 27 can be a set of different colors.

Play continues as described in Example 7, until a player has played all of that player's drawn shape cards, or every player is unable to place a shape. At the end of play, the winner is the player to complete their puzzle first, i.e. to use all the shape cards 20 in their hand. On a mutually agreed upon "stopped" round, the winner of the round is the player with the fewest shapes. The tiebreaker is the player with the fewest empty spaces. For extended play, play continues for an additional round or rounds by placing shape cards 20 back in the deck and the letter tiles placed in the bag and starting new puzzles. The winner is the first player to win 3 rounds (with 4 players), to 4 rounds (with 3 players), and to 5 rounds (with 2 players).

Example 14

Figure 8:
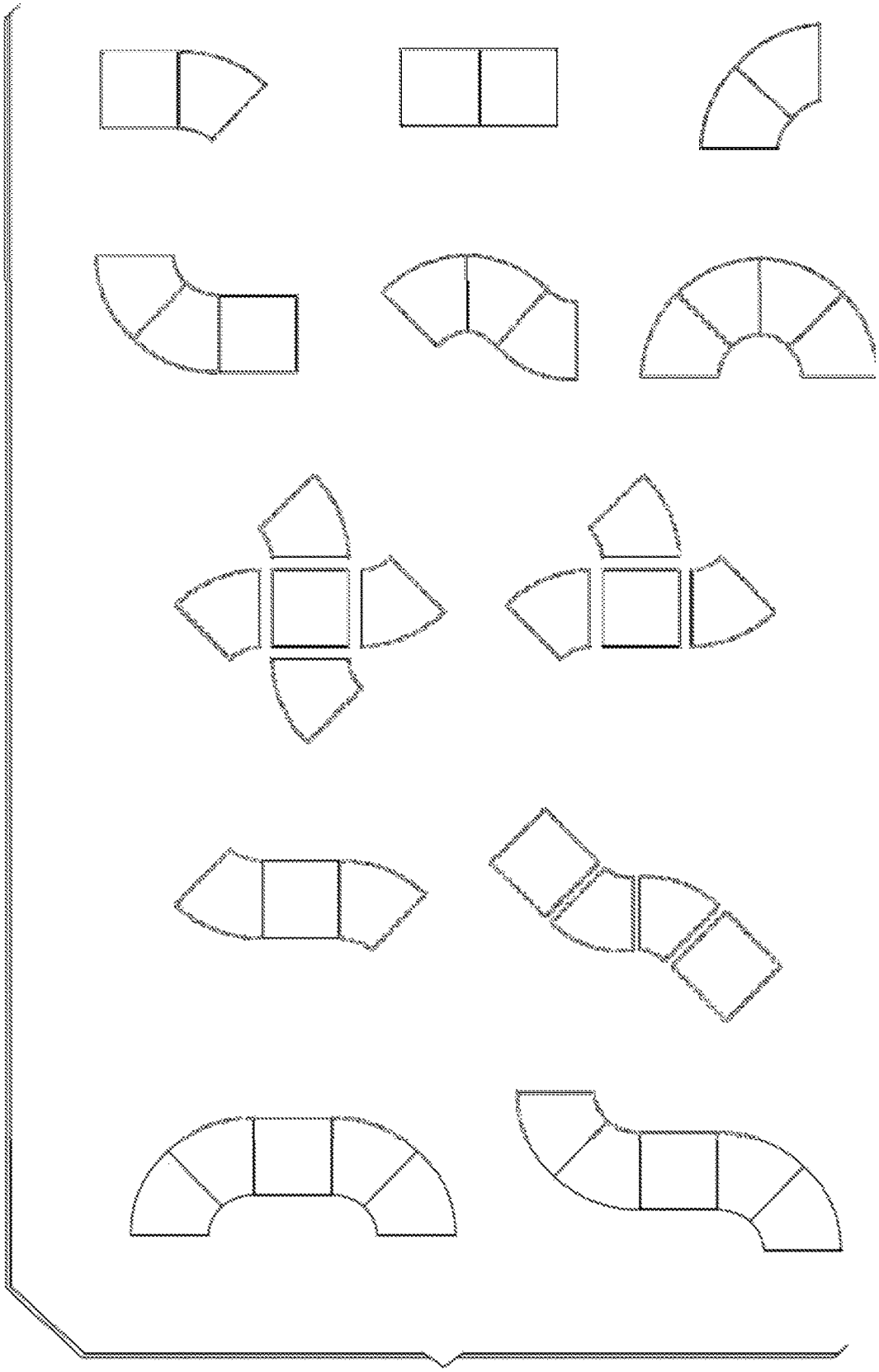
FIG. 8 is a plurality of diagrams of the shape designs of one embodiment using curved shape puzzle pieces.
Figure 9A:
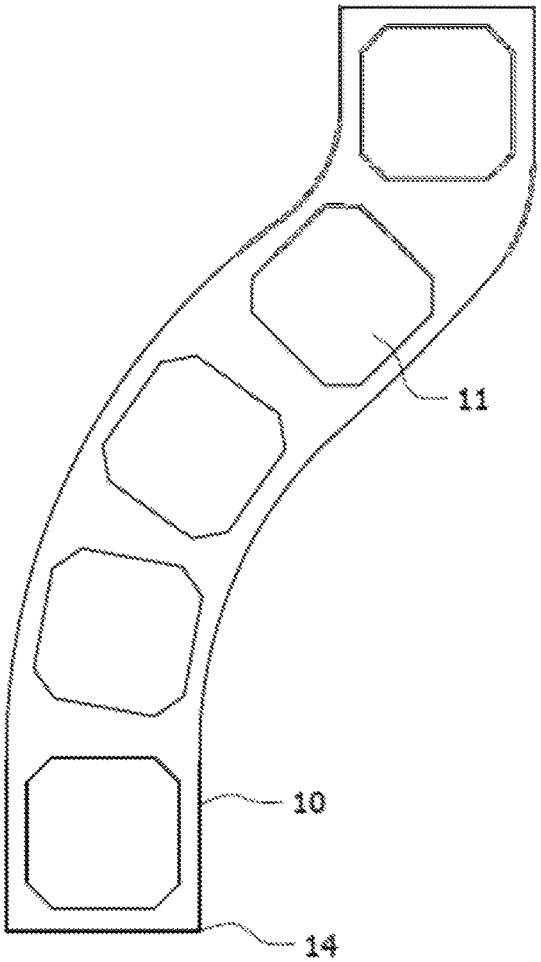
FIG. 9(A) is a diagram of an exemplary first shape designs for the curved shape embodiment.
Figure 9B:
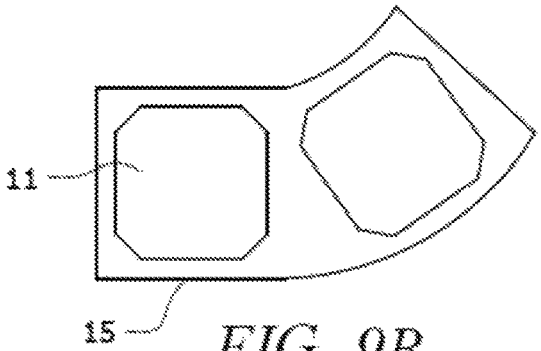
FIG. 9(B) is a diagram of a second shape designs for the curved shape embodiment.

This variation uses thirty-two shapes 10 in sixteen distinct designs, as seen in FIG. 8, with curved playing pieces with a flat surface 14 on one side and a squared off edge 15 on the other side or two squared off edges, as seen in FIGS. 9(A) and 9(B). In some embodiments, shapes 10 are assigned varying point values ranging from one to eight. Shape cards 20, corresponding to each of shapes 10 are used to designate the point value for each shape and indicate which shapes a player is assigned to play. The games uses one hundred twenty-four tiles 1, which include one hundred four assigned letter tiles, eight "wild" letters that can be used as any letter, and twelve "block" tiles that function as a space to permit multiple words on a shape. Alternatively, tiles 1 are comprised of colors, animals, board game play icons/instructions, token pieces, icons, fruit icons, or other design known in the art.

Shapes 10 are placed together on a playing surface, such as a table, ensuring there is adequate space to play and connect shapes. Tiles 1 are placed into a bag and mixed. Each player selects eight tiles from the bag and places the tiles in front of the player. Shape cards 20 are shuffled and cards dealt to each player. For four players, three cards are dealt to each player. For two or three players, four shape cards are dealt to each player. The remaining shape cards are placed on the table with obscuring face 22 facing up. Each player selects a single tile from tile bag to determine the starting player and then returns the tile to the bag. The player with the letter closest to "A", not including the wild or the block, goes first. Where tiles 1 are comprised of colors, animals, or board game play icons/instructions, players may roll dice or select a shape card to determine the first player. The player with the lowest roll or score value 24 on the shape card initiates play. Alternatively, the highest roll or score value 24 on the shape card initiates play. Play moves clockwise.

During a turn, the player selects at least one shape card 20 and collects a shape corresponding to shape identifier 23 on the shape card. Shape 10 is placed on the table, with each shape played connecting to one or more shapes already played, with the exception of the first shape played in the game, to form puzzle 8, as seen roughly in FIG. 5. To successfully play a shape, tiles 1 must be placed on every tile protrusion 11 of shape 10, with a two letter minimum word or two tile minimum sequence. Shape 10 must be connected to puzzle 8 by connected a flat edge of shape 10 to a flat edge of a shape on puzzle 8, i.e. shape 10 cannot be connect to curved edge on another shape. Where shape 10 includes a squared off edge, the shape may be played in any direction on that side. Additionally, the letter on a played space "connected" shape space must be used as part of the word on the newly placed shape. Where the tiles are comprised of colors, animals, or board game play icons/instructions, the tiles must be played to form a predetermined sequence. When a "wild" tile is used, the "wild" letter is not a fixed letter during play, i.e. the "wild" tile is changed by each player connecting to the wild tile based on the player's needs. Alternatively, the puzzle is used as a game path after the puzzle is completed. In such variations, the wild tile is also used as a game play device such as go to another wild tile, pull random tile to determine movement of pawn, or as a "collect a tile" if landed on or passed. Abbreviations, acronyms, proper names, or hyphened words are not permitted. Tiles 1 are selected from the player's tiles 1*a*, which are optionally stored on tile rack 9 until needed, and placed onto each tile protrusion 11 of shape 10 forming one or more words in any direction. Where the player can successfully play multiple shapes, the player continues adding shapes to the puzzle If a shape cannot be played, any or all tiles 1 or shape cards 20 may be exchanged by discarding the unwanted tiles and/or cards and selecting shape cards from the shuffled deck and tiles from the tile bag.

Upon completing a turn, the player places the shape cards representing the successfully played shapes in front of the player for later scoring. The player then replenishes the player's tiles 1*a* from the tile bag to reach eight tiles, and replenishes any played shape cards from the shape card deck. Where a player successfully connected a shape to more than one existing shape on puzzle 9, the player is given a bonus and draws an additional tile for each played shape that connected to more than one shape.

Play continues until a player has played all of that player's shape cards and the shuffled "draw" deck is exhausted, or every player is unable to place a shape in the same round. At the end of play, shape cards are used to determine score. Score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

In some embodiments, the paths are used as game paths in a board game after completion.

Example 15

Play piece 50 has a linear shape and five spaces on each piece. The five spaces are optionally tile protrusions 11, as described above. Clue cards 55 are also provided, and may be made of any material which is used to form shape cards 20. Exemplary clue cards include "wild letter", "random letter", "before and after", "rhyme", "starts with", and "categories", as seen in FIG. 4(E). However, other types of clue categories may be provided, as would be apparent to one skilled in the art.

A series of five play pieces 50 are given to each player. Tiles 1 having letters imprinted on the face are provided in a "community" location, where each player has access to the same pool of tiles 1, with wild letters randomly available. Clue cards 55 are arranged in clue categories and each clue category shuffles. Each player is given five clue cards, corresponding to each of the five play pieces 50. Each clue card originates from a unique category, i.e. no clue categories are repeated, and each player is given clue cards from the same categories.

Figure 10:
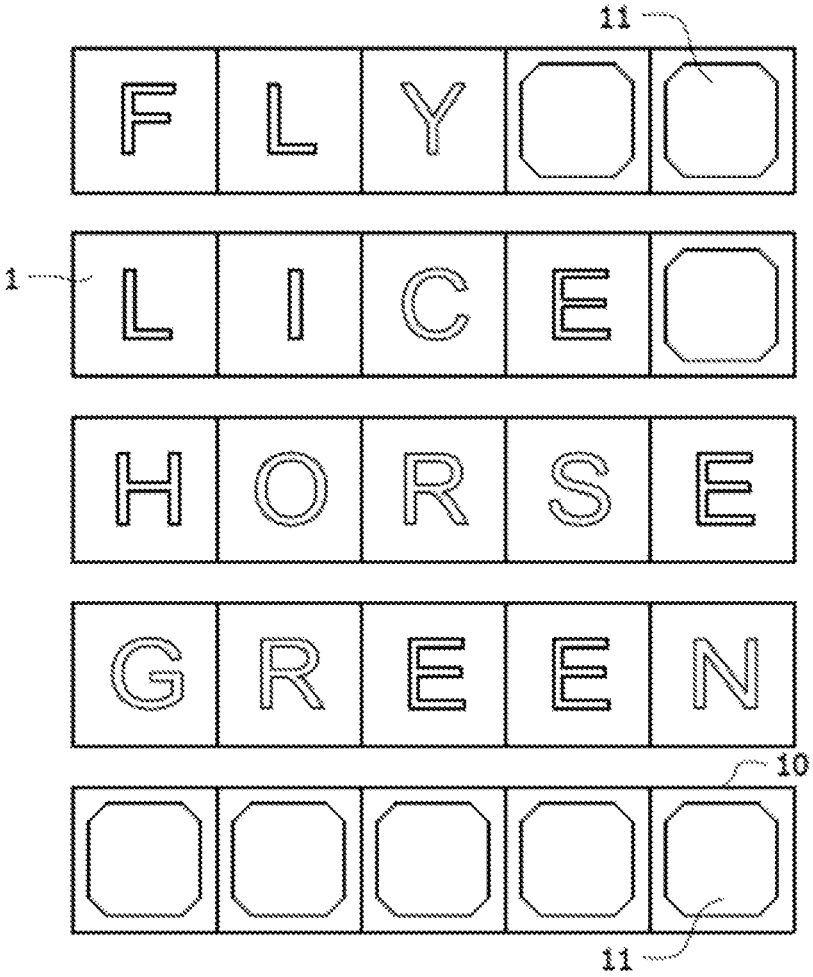
FIG. 10 is a diagram of an exemplary game using straight shapes in a clue-based word game.

Play begins once every player received his or her clue cards and tiles. Each player reviews the clue provided on clue card 55 and develops a word solution to the clue. Each word must contain between three and five letters. Upon forming a solution, the player collects tiles from the common pool of tiles 56 and places the tiles onto play piece 50 which corresponds to the clue. For example, a player is given a "before and after" clue stating the following "butter_____swatter". The player collects the letters "F", "L", and "Y", and places them onto the appropriate play piece 50, spelling out "fly", as seen in FIG. 10. In some variations, the player must complete a clue before he or she may move to the next clue card.

In some instances, there are a limited number of tiles 1, requiring a player to form a new solution to a clue. For example, the clue may be "a color". The player's first solution may be "blue", but upon collecting the requisite tiles, the player realizes the "B" tile has been played. The player then forms a new solution, such as "green" and collects the tiles for the new solution, playing them on play piece 50.

The gameplay finishes when the first player completes all five columns or all players can no longer form words with the remaining clues and tiles. At this point, each player attempts to align columns to form words vertically. Alternately, game play continues until a player can form a vertical word by aligning the shapes. In some variations, a sixth clue card is used to provide a clue for solving the vertical word. In such variations, the players must align the shapes to form a solution to the sixth clue. Once complete, each player's scores are tallied as follows: one point for every letter played per column, 5 points are awarded to the first player to complete all five clues, and 1 point is awarded to each letter used to form a vertical word. The player with the highest score wins.

In an alternative variation of the game, each player collects 5 strip shapes and twenty-five letter tiles. A single clue card is selected and the tiles are placed onto the shapes. The tiles do not need to form words. The shapes are then aligned and positioned to form a vertical word or words. Players earn points by solving the clue first, which is awarded 5 bonus points. One point is awarded for each letter used to form a vertical word letter, and ten bonus points awarded for each vertical word that answers the clue.

Example 16

This variation uses a turn-based game using twenty-four shapes 10 in twelve distinct designs. Twenty-four shape cards 20, corresponding to each of shapes 10 are used to indicate which shapes a player is assigned to play. The games uses one hundred twelve tiles 1, which include eight tiles for each of three indicia and four for each color combinations, and sixteen "wild" tiles. Playing pawns and a start/finish square are also used.

Shapes 10 are placed together on a playing surface, such as a table, ensuring there is adequate space to play and connect shapes. Tiles 1 are placed into a bag and mixed. Each player randomly selects ten single letter tiles from the bag and places them in front of them, forming a tile pile. The Start/Finish Square is placed on the table.

Shape cards 20 are shuffled and twelve of the shape cards randomly selected and placed on the table with obscuring face 22 facing up. The youngest player initiates gameplay. Play moves clockwise.

During a turn, the player selects the top shape card 20 and collects a shape corresponding to shape identifier 23 on the shape card. The first shaped is positioned such that a flat end of the shape is adjacent to the Start/Finish Square. The player places tiles onto the shape by matching the color or indicia on the adjacent tile. A "wild" tile may be used as any color or indicia, and can be changed for anyone connecting to the wild tile. If a player is unable to place a shape, the player may elect to exchange any or all of the tiles in the player's tile pile. The unused shape is transferred to the next player for placement. The shape card corresponding to a successfully played is discarded at the end of a turn and the player selects new tiles to replace the tiles used in successfully playing a shape.

Play continued until all the twelve shape cards have been played, or a minimum of 8 path shapes have been connected to the Start/Finish Square. The winner is the player to place a path shape that reaches from the Start/Finish square back to the Finish Square, i.e. a complete path loop is formed. There is no winner if the paths do not reach the Finish Square.

Alternatively, eighteen of the shape cards are selected and used for gameplay. Play continues as described above until all the shape cards have been played, or until a minimum of twelve path shapes have been connected and reaches the Start/Finish Square. Once the pathways are completed, the pawns are placed onto the start square and each player selects a tile from the tile bag. The player advances his or her pawn to the nearest space depicted on the drawn tile. For example, where an apple tile is selected, the player moves his or her pawn to the nearest apple tile on the pathways. If a wild is drawn, the pawn is advanced to the nearest wild space and another tile is drawn. The pawn is advanced to that space, completing the player's turn. The winner is the player to move his or her pawn to the Finish Square. At the end of a turn, the drawn tile is placed back into the tile bag.

For more challenge, all twenty-four shape cards are selected and used for gameplay. Three shape cards are dealt to each player and the pawns are placed onto the Start/Finish square. The first shaped is positioned such that a flat end of the shape is adjacent to the Start/Finish Square. The player places tiles onto the shape as described above. Where a player is unable to play a shape, the player may elect to exchange any or all the tiles in the player's tile pile, and/or shape cards. The player's pawn is advanced to the nearest color space that corresponds to the player's pawn color, except that the pawn may not advance past a wild space. Where a wild space blocks a pawn, the pawn is placed on the wild space and a tile drawn from the bag. The pawn is advanced to the nearest color depicted on the tile. Where a wild tile is drawn, the pawn is moved back to the nearest tile corresponding to the pawn's color. At the completion of a turn, the player replenishes his or her tiles from the tile bag, and selects new shape cards to replenish the played shape cards. At the end of a turn, the drawn tile is placed back into the tile bag. Play continues until all of the shape cards are used or a minimum of sixteen path shapes have been connected and connect to the Start/Finish Square. The winner is the player to move his or her pawn to the Finish Square.

Example 17

This variation uses shapes described in any of Examples 2 through 16. Shape cards 20, corresponding to each of shapes 10 are used to indicate which shapes a player or team is assigned to play. Alternatively, game play can be "free form" in that a player selects any available shape 10 for play. In some variations, paths initiate from a start location, such as start tile. The games uses tiles 1, which include one or more indicia on the indicator face, where the indicia are colors, animals, board game play icons/instructions, token pieces, icons, fruit icons, or other design known in the art. Players/teams build one or more paths using shape 10 from the start location, placing tiles on shape 10. In instances where a player or team inserts a sequence of tiles that correspond, the player or team draws another shape and continues game play until the player or team is unable to complete a shape. At that point, game play passes to the next player or team. Play can initiate as described in previous examples, such as by rolling dice.

Figure 9C:
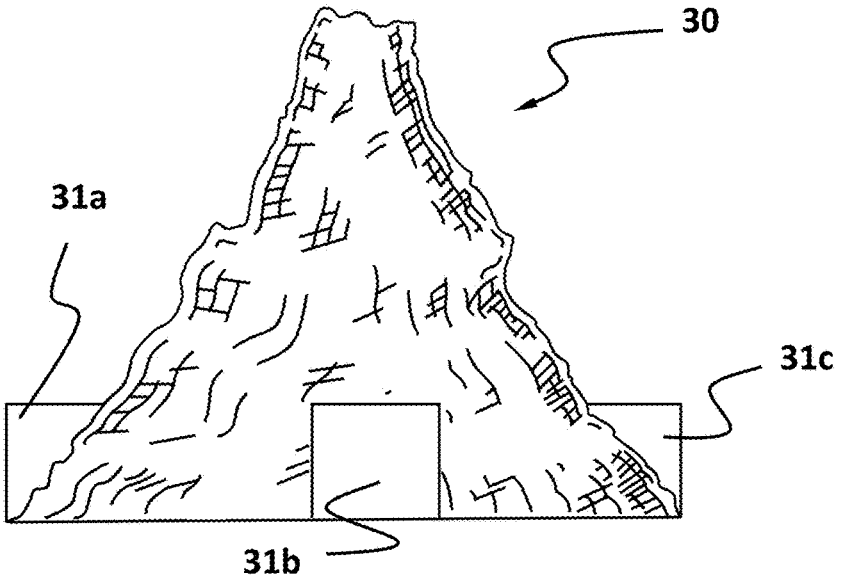
FIG. 9(C) is a side view of a starting tile. The starting tile is shaped as a 3-dimensional game structure, here a mountain with four playable locations.
Figure 9D:
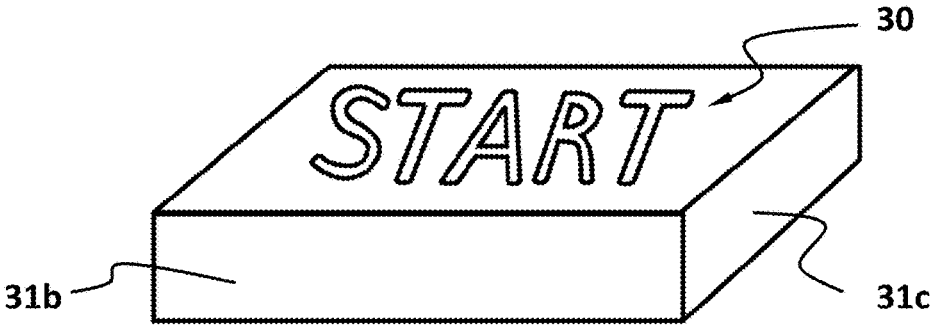
FIG. 9(D) is an isometric diagram of a starting tile. The starting tile is shaped with four playable locations.

As a non-limiting example, the game can be animal-themed, using an animal habitat start tile, 30 seen in FIGS. 9C through 9E. Start tile 30 includes first playable face 31*a*, second playable face 31*b*, third playable face 31*c*, and so forth as provided for in the gameplay. The first player/team attached a shape to the start tile and places tiles having animal indicators on the face. In some variations, the start tile can alternatively be a playable shape, i.e. locations are provided on the playable shape to permit placement of tiles. Non-limiting examples include the start tile is a box-to-board playable shape, seen in FIG. 9C, such as a mountain or other structure thematically linked to the game. The game play may include cards or instructions, such as instructions printed on the start tile, indicating which tiles can be played on a shape. In the animal example, a card can designate a series of animals or types of animals that must be played on the shape or a minimum number of animal types that must be played on the shape. Where the player or team is able to place a single type of animal congruently on the tile, such as three of a specific animal in a row, the player or team is allotted another shape to play during their turn as a bonus turn or is permitted to continue playing shapes until the player is unable to successfully play a shape. In the event a player is unable to play a tile or shape, the player loses a turn, or a tile is placed in a non-playable area of the game. For example, the animal game can include an antagonist, such as an animal poacher. Where the player cannot play a tile, the tile with the animal is placed into the poacher's tile. Playing specialty tiles or drawing specialty cards may permit the non-playable tiles to be returned to play. To further enhance the strategy aspects of the game, the animal poacher or other antagonist is placed on the next open space on any path at the end of a turn. Players can advance their pawns to an animal shape designated during their turn, such as by a play card, and advance to the next tile showing the designated animal shape. Play continues until a player completes the path, the antagonist completes the path, and/or the non-playable area of the game is filled with tiles. As a non-limiting example using the poacher, once the poacher's tile is filled with animal tiles, gameplay finishes. As such, the positioning of open spaces on various game pathways, such as ancillary paths, provides to prevent blocking of the main path and enhances the strategy and puzzle solving objectives required for the game.

Example 18

This variation utilizes the shapes and game play described in the previous examples. Tiles 1 are disposed in irregular shapes, such as shapes designed to fit onto a curved shape 10. Alternatively, tile 1 can be a non-square geometric shape, such as a triangle, circle, or hexagon. Tile 1 can also alternatively be a three-dimensional shape, such as a house, castle, rock, cube, or other shape known in the art. For example, game paths can be built as described in Examples 16 and 17, with two-dimensional game play tiles. Specialty tiles, such as a house, can be placed on a shape in place of a two-dimensional game play tile, forming a game play obstacle or other means of effecting game play. For example, a house may provide protection from an adverse event, such as heavy rains provided during game play, as seen by a pawn arriving on an adverse event or player selecting a game play card having an adverse event. Players protected from the event gain specific advantages, such as not losing a game play turn. In some variations, the start tile, end tile, specific destination tiles provided in the game paths for game play, etc. can be three dimensional. Additionally, gameplay can include three dimensional playable shapes, such as a box-to-board obstacle or playable shape. In some embodiments the obstacle or playable shape plays as a shape, i.e. tiles can be placed on the structure to create pathways for game play. For example, the start tile, end tile, specific destination tiles can be playable shapes, such as described in Example 17. In specific embodiments, the three-dimensional structures are adapted to accept tiles, allowing the game play paths to traverse the three dimensional structures.

Alternatively, the tiles can be three dimensional tiles played as described in the previous examples, allowing players to match three dimensional structures, types of structures, etc.

Example 19

Game play and the game are as described in previous examples. However, tile 1 is adapted to accept additional tiles, allowing players to stack tiles on the shapes. For example, where the mathematical operators are used, a player could modify an operation by stacking additional tiles onto the played piece. To illustrate this, player 1 places tiles showing "2", "+", "4", "6", player 2 can stack tiles "x" and "8" to modify the operation to read "2", "x", "4", "8". The game can also provide for stacking similar tile shapes, etc., allowing a player to create stairs on a path, shortcut on a path, or build an elevated path to access a three dimensional shape for game play described in Examples 16 through 18. Alternatively, the tiles can be stacked based on multiple parameters of the indicia, such as by color, or icon.

Example 20

This variation of the game is as in previous examples. However, shape 10 is a geometric shape, such as a triangle, with the body of the shape segregated into smaller geometric shapes. For example, where shape 10 is a triangle, the shape can be segregated into four, triangular playable regions. In this instance, tile 1 is triangular and adapted such that four triangular tiles fit onto shape 10. Tiles can be played by placing triangular shapes adjacent to each other and playing tiles such that adjacent tiles match indicia, such as color or icon, as described previously. Where the tiles and shapes are used to form game play paths, pathways can be provided on tiles based on color, etc. In another example, shape 10 is a hexagon, with six triangular segregated parts, as described above.

Example 21

This variation of the game is as in previous examples. However, shape 10 includes one or more indicia on its face that correspond to indicia on tile 1. For a tile to be played on a space disposed on shape 10, the indicia on tile 1 must match the indicia on shape 10, by color, icon, other indicia as described above, or a combination thereof.

Example 22

Game play and the game are as described in previous examples. However, gameplay is modified by providing bonuses for not placing designated tiles, placing tiles on designated spaces, or matching a tile to an indicia on a space. For example, gameplay using a series of cat and rat tiles, provides maximizing the number of cat tiles played on a shape, while concurrently minimizing the number of rat tile played. In the event a player is able to successfully play a tile without using any rat tiles, the player received a bonus on his or her score. In alternative embodiments, a shape may include a point multiplier on the space, such as a "2×" thereby increasing the points awarded to the player using such a space.

In the preceding specification, all documents, acts, or information disclosed do not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of a tile on shape puzzle game and methods of play, it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention which, as a matter of language, might be said to fall therebetween.

What is claimed is:

1. A tile-on-shape puzzle game comprising:

at least one tile, wherein the at least one tile is either a first tile design or a second tile design;

wherein the first tile design further comprises:

an upper face;

a plurality of edges, where the plurality of edges is at least three linear edges, curved edges, or combination of linear edges and curved edges;

a lower face;

a play indicia disposed on the upper face;

wherein the second tile design further comprises:

an upper face;

a plurality of edges, where the plurality of edges is at least three linear edges, curved edges, or combination of linear edges and curved edges;

a lower face;

a play indicia disposed on the upper face;

at least one projection extending from the lower face;

a plurality of playing shapes, further comprising:

a shape surface having a first face and a second face;

a plurality of shape edges, where the plurality of shape edges is at least three linear edges, circumferential edges, or combination of linear edges and circumferential edges;

a plurality of sides, wherein the plurality of sides have a width smaller than the width of the first face;

at least one recess disposed on the first face, wherein the recess is complementary to the at least one tile of the first tile design or a projection extending from the at least one tile of the second tile design;

wherein the at least one recess has at least three linear edges, octagonal edges, circumferential edges, or combination of linear edges and circumferential edges;

wherein the at least one recess is dimensioned such that the at least one tile or the projection extending from the at least one tile is accepted within the at least one recess; and at least one inverse tile recess disposed on the second face of the playing shapes and corresponding to the inverse location of the at least one recess on the at least one shape disposed on the first face;

wherein the at least one inverse tile recess has at least three linear edges, octagonal edges, circumferential edges, or combination of linear edges and circumferential edges;

wherein at least two of the edges of the recess are parallel to each other; and wherein the at least one inverse recess is dimensioned such that the at least one tile or the projection extending from the at least one tile is accepted within the at least one inverse tile recess.

2. The tile-on-shape puzzle game of claim 1, wherein the play indicia is a letter, number, color, shape, fruit, animal, character, icon, math equation operator, board game play icons, board game play instructions, candy, or a combination thereof.

3. The tile-on-shape puzzle game of claim 1, further comprising:

a plurality of play cards, wherein the plurality of play cards comprise at least one indica face;

where the indicia face includes a gameplay item, wherein the gameplay item is a shape identifier, a shape identifier and score value, a gameplay theme, a clue, gameplay instructions, gameplay goal, gameplay character information, gameplay character properties, color, or a combination thereof.

4. The tile-on-shape puzzle game of claim 3, wherein the plurality of playing shapes are molded in a color corresponding to the color indicia on the plurality of play cards, wherein the shape surface is molded in a color corresponding to a color indicia on the plurality of play cards and the tile protrusion is molded in a white or beige, or wherein the shape surface is molded in white or beige and the tile protrusion is molded in a color corresponding to the color indicia on the plurality of play cards.

5. The tile-on-shape puzzle game of claim 3, wherein the plurality of play cards comprise a combination of gameplay items disposed on the indicia face.

6. The tile-on-shape puzzle game of claim 1, further comprising:

at least one tile projection disposed on the lower face of the at least one tile;

wherein the at least one tile projection on the lower face of the at least one tile is dimensioned to fit in the at least one recess disposed on the first face of the playing shape.

7. The tile-on-shape puzzle game of claim 1, wherein the plurality of playing shapes are wood, cardboard, high density fiberboard, high density cardboard, high density paper, acrylonitrile butadiene styrene, high impact polystyrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile.

8. The tile-on-shape puzzle game of claim 1, wherein the plurality of tiles are wood, cardboard, high density fiberboard, high density cardboard, high density paper, acrylonitrile butadiene styrene, high impact polystyrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile.

9. The tile-on-shape puzzle game of claim 8, wherein the plurality of tiles comprise:

at least one tile projection disposed on the lower face of the at least one tile;

wherein the at least one tile projection on the lower face of the at least one tile is dimensioned to fit in the at least one recess disposed on the first face of the playing shape; and wherein the at least one tile projection is ferromagnetic material, ferromagnetic sheet, ceramic magnet sheet, nickel sheet, cardboard, high density fiberboard, high density cardboard, high density paper, acrylonitrile butadiene styrene, high impact polystyrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile.

10. A method of playing a tile-on-shape game comprising:
providing a plurality of tiles, where the plurality of tiles are a first tile design or second tile design;
wherein the first tile design further comprises:
an upper face;
a plurality of edges, where the plurality of edges is at least three linear edges, circumferential edges, or combination of linear edges and circumferential edges;
a lower face;
a play indicia disposed on the upper face;
wherein the second tile design further comprises:
an upper face;
a plurality of edges, where the plurality of edges is at least three linear edges, circumferential edges, or combination of linear edges and circumferential edges;
a lower face;
a play indicia disposed on the upper face;
at least one projection extending from the lower face, where the at least one projection is a singular projection, an octagonal projection, or a plurality of projections;
wherein the at least one projection is dimensioned to fit in a recess in a plurality of playing shapes;
wherein the singular projection further comprises a plurality of edges of the projection parallel to the plurality of edges of the at least one tile;
wherein the octagonal projection further comprises:
a first side, a second side, a third side, a fourth side, a fifth side, a sixth side, a seventh side and an eighth side;
wherein the first side, the third side, the fifth side, and the seventh side are parallel to the plurality of edges and form a lips;
wherein the second side is disposed 45 degrees to the first side and the third side, the fourth side is disposed 45 degrees to the third side and the fifth side, the sixth side is disposed 45 degrees to the fifth side and the seventh side, and the eighth side is disposed 45 degrees to the seventh side and the first side:
wherein the plurality of projections are at least two cylindrical projections;
providing a plurality of playing shapes, where the plurality of playing shapes comprise:
a shape surface having a first face and a second face;
a plurality of shape edges, where the plurality of shape edges is at least three linear edges, circumferential edges, or combination of linear edges and circumferential edges;
a plurality of sides, wherein the plurality of sides have a width smaller than the width of the first face;
at least one recess disposed on the first face, wherein the recess is complementary to the at least one tile of the first tile design or a projection extending from the at least one tile of the second tile design;
wherein the at least one recess is dimensioned such that the at least one tile or the projection extending from the at least one tile is accepted within the at least one recess;
at least one play surface disposed on the first face of the playing shape, where the play surface defines the placement of one tile;
mixing the plurality of tiles together, wherein the plurality of tiles are mixed in a bag or pile;
selecting at least one tile from the bag or pile wherein the selected tiles form a player's tile pile;
constructing a gameplay puzzle, comprising:
placing a plurality of play shapes into play, wherein the play shapes adjoin at least one other play shape on at least one of the plurality of shape edges;
placing at least one tile from the player's tile pile onto each play surface of the played shape, wherein the tile placement forms at least one word or sequence of numbers, colors, math equations, pathways, or icons on the played shape;
wherein the at least one tile is placed into the at least one recess of the plurality of playing shapes where the tile is the first tile design, or wherein the projection is placed into the at least one recess of the plurality of playing shapes where the tile is the second tile design; and
continuing play until a scoring event is triggered, wherein the scoring event is a first player to complete use of the player's play shapes, successfully playing all play shapes, or every player is unable to place a shape in the same round.

11. The method of playing a tile-on-shape game of claim 10, further comprising determining a winner after a scoring event is triggered, wherein the winner is determined by completing the puzzle in a designated time, completing the puzzle before any other player, returning a player pawn to a designated finish tile before any other player, or tallying a score for each player, wherein the score is tallied using a plurality of shape cards used during gameplay, played shapes, or the first player to complete use of the player's play shapes.

12. The method of playing a tile-on-shape game of claim 10, further comprising:
providing a plurality of play cards, wherein the plurality of play cards comprise an indica face and an obscuring face and where the indicia face includes wherein the plurality of play cards comprise a plurality of gameplay topics disposed on the indicia face;
shuffling the plurality of play cards;
selecting a play card; and
selecting one of the gameplay topics on the play card;
wherein the score is determined by player forming at least one word based on the gameplay topic.

13. The method of playing a tile-on-shape game of claim 10, further comprising:
providing a die;
rolling the die to determine a word play length, where the word play length is the number of characters in a word during game play; and
wherein the score is determined by player forming at least one word at the word play length.

14. The method of playing a tile-on-shape game of claim 10, further comprising replenishing played shape cards from a shape card deck.

15. The method of playing a tile-on-shape game of claim 10, further comprising adjoining tiles to form words, wherein the words are formed in any direction, formed left-to-right, top-to-bottom, or a combination thereof.

16. The tile-on-shape puzzle game of claim 1, further comprising a starting base shape, wherein the starting base shape is a three-dimensional reproduction of a game theme having at least one playable location, a square, and
wherein the shape is a shape possessing different gameplay hazards, a shape possessing a gameplay instructions, a shape possessing a habitat image, a shape possessing a location image, a shape having a three-dimensional habitat structure, or a shape having a three-dimensional location structure.

17. The tile-on-shape puzzle game of claim 1, further comprising providing challenge cube or die, wherein at least one indicia is disposed on at least one face of the challenge cube or die;

wherein the at least one indicia is a length of word to be played, a color to be played, dots, numbers, colors, or a gameplay goal; and wherein the gameplay goal is a numerical sequence, a number of tiles to play, a mathematical operator value, an interaction with another player.

18. The method of playing a tile-on-shape game of claim 10, further comprising providing a starting base shape, wherein the starting base shape is a three-dimensional reproduction of a game theme having at least one playable location, a square, and wherein the shape is a shape possessing different gameplay hazards, a shape possessing a gameplay instructions, a shape possessing a habitat image, a shape possessing a location image, a shape having a three-dimensional habitat structure, or a shape having a three-dimensional location structure; and placing the play shapes are adjacent to the starting base or on a portion of the starting base.

19. The method of playing a tile-on-shape game of claim 10, further comprising providing challenge cube or die, wherein at least one indicia is disposed on at least one face of the challenge cube or die;

wherein the at least one indicia is a length of word to be played, a color to be played, dots, numbers, colors, or a gameplay goal;

wherein the gameplay goal is a numerical sequence, a number of tiles to play, a mathematical operator value, an interaction with another player.

20. The method of playing a tile-on-shape game of claim 10, wherein the at least one projection extending from the lower face of the second tile design further comprises:

where the at least one projection is a singular projection, an octagonal projection, or a plurality of projections;

wherein the singular projection further comprises a plurality of edges of the projection parallel to the plurality of edges of the at least one tile;

wherein the singular projection is circumscribed by at least three flanges, where a width of each of the plurality of flanges have substantially the same width;

wherein the octagonal projection further comprises:

a first side, a second side, a third side, a fourth side, a fifth side, a sixth side, a seventh side and an eighth side;

wherein the first side, the third side, the fifth side, and the seventh side are parallel to the plurality of edges and form a lip;

wherein the second side is disposed 45 degrees to the first side and the third side, the fourth side is disposed 45 degrees to the third side and the fifth side, the sixth side is disposed 45 degrees to the fifth side and the seventh side, and the eighth side is disposed 45 degrees to the seventh side and the first side; or wherein the plurality of projections are at least two cylindrical projections.

* * * * *